US006464449B1

(12) United States Patent
Takeno

(10) Patent No.: US 6,464,449 B1
(45) Date of Patent: Oct. 15, 2002

(54) COLLATING APPARATUS WITH ERROR DETECTION

(75) Inventor: Mitsuru Takeno, Ibaraki-ken (JP)

(73) Assignee: Riso Kagako Corporation, Tokyo (JP)

( * ) Notice: Subject to any disclaimer, the term of this patent is extended or adjusted under 35 U.S.C. 154(b) by 0 days.

(21) Appl. No.: 09/624,893

(22) Filed: Jul. 24, 2000

(30) Foreign Application Priority Data

Jul. 26, 1999 (JP) ..... 11-210883

(51) Int. Cl.[7] ..... B65G 57/00

(52) U.S. Cl. ..... 414/791.2; 271/9.11; 271/218; 399/404; 270/58.03

(58) Field of Search ..... 414/791.2; 271/9.02, 271/9.11, 9.12, 9.13, 94, 98, 105, 31, 207, 213, 220, 221; 270/52.01, 52.04, 52.06, 58.01, 58.03, 58.11, 58.23, 58.25; 399/403, 404

(56) References Cited

U.S. PATENT DOCUMENTS

| | | | | | |
|---|---|---|---|---|---|
| 2,873,966 | A | * | 2/1959 | Lambert | 271/9.02 |
| 3,536,318 | A | * | 10/1970 | Gay et al. | 270/58.11 |
| 3,997,154 | A | * | 12/1976 | Mol | 414/791.2 X |
| 4,072,304 | A | * | 2/1978 | Brown et al. | 270/52.04 |
| 4,091,978 | A | * | 5/1978 | Graham, II | 414/791.2 X |
| 4,498,663 | A | | 2/1985 | Wamsley et al. | |
| 5,039,077 | A | * | 8/1991 | Gunther, Jr. | 270/52.02 |
| 5,125,635 | A | * | 6/1992 | Iwabuchi | 270/56 |
| 5,188,353 | A | * | 2/1993 | Parks | 271/184 |
| 5,499,806 | A | * | 3/1996 | Bourg | 271/9.11 |
| 5,810,349 | A | * | 9/1998 | Bloser et al. | 271/213 |
| 6,125,439 | A | * | 11/2000 | Hirayama et al. | 270/52.04 |
| 6,189,880 | B1 | * | 2/2001 | Besold | 270/58.25 |

FOREIGN PATENT DOCUMENTS

| | | |
|---|---|---|
| CH | 475 852 | 7/1969 |
| DE | 954 506 | 12/1956 |
| EP | 0 968 948 A2 | 1/2000 |
| JP | 07101615 | 4/1995 |
| JP | 11005379 | 12/1999 |

* cited by examiner

*Primary Examiner*—Christopher P. Ellis
*Assistant Examiner*—Patrick Mackey
(74) *Attorney, Agent, or Firm*—Nath & Associates PLLC; Gary M. Nath; Lee C. Heiman

(57) ABSTRACT

According to the collating apparatus of the present invention, if the collation error is detected, the erroneously collated matter selection and discharge unit discharges the erroneously collated matter so as to be distinguishable from the correctly collated matters. Besides, the collation error can be recognized and the erroneously collated matter can be removed after the collation operation is completed for all collated matters. Therefore, it is possible to continue the collation operation without stopping the collation operation when the collation error occurs.

6 Claims, 20 Drawing Sheets

RIGHT-SHIFT

LEFT-SHIFT

COLLATING APPARATUS WITH ERROR DETECTION

BACKGROUND OF THE INVENTION

1. Field of the Invention

The present invention relates to a paper collating apparatus for stacking a plurality of types (contents) of paper in a predetermined order and for discharging them as a collated matter.

2. Description of the Related Art

FIG. 1 is an overall perspective view of a collating apparatus. FIG. 2 is a perspective view of the neighborhood of a stacker section of the collating apparatus.

In FIGS. 1 and 2, the collating apparatus is provided with a paper feed section 71 having a plurality of paper feed trays 70*a* to 70*j* arranged vertically and conveying many sheets 72 stacked on the respective paper feed trays 70*a* to 70*j* one by one at predetermined timing, a collating and conveying section (not shown) collating the plural sheets 72 conveyed from the respective paper feed trays 70*a* to 70*j* of the paper feed section 71 to provide collated matters 73 (shown in FIG. 3B) and conveying the collated matters 73 to a discharge section 74, the discharge section 74 discharging the collated matters 73 conveyed from the collating and conveying section (not shown) to a stacker section 75, and the stacker section 75 stacking the collated matters 73 discharged from the discharge section 74.

The stacker section 75 has a paper discharge tray 76 provided at the falling position of the collated matters 73 discharged from the discharge section 74, and a pair of side fences 77 and 78 positioned on both outer sides of the collated matters 73 discharged onto the paper discharge tray 76 and restricting an orthogonal direction to the discharge direction of the collated matters 73. The widths of paired side fences 77 and 78 are variable according to the widths of the sheets 72 to be collated.

Also, the stacker section 75 is provided with sorting means 79. This sorting means 79 consists of a fixed base tray 76*a*, a movable paper discharge tray 76*b* horizontally movable on the fixed base tray 76*a*, and a driving mechanism (not shown) applying a driving force to horizontally move the movable paper discharge tray 76*b*.

With the above configuration, many sheets 72 sorted according to paper types are stacked on, for example, the uppermost paper feed table 70*a* to the lowermost paper feed table 70*j*, respectively. One unit of a collated matter 73 obtained by stacking sheets in the vertical order of these paper feed trays 70*a* to 70*j* will be described.

When a start mode is selected, respective sheets 72 from the uppermost paper feed tray 70*a* to the lowermost paper feed tray 70*j* are sequentially conveyed with predetermined timing delays. The conveyed sheets 72 are collated by the collating and conveying section (not shown) to thereby provide collated matters 73. The resultant collated matters 73 are discharged to the stacker section 75 through the discharge section 74. By executing the series of operations continuously, many collated matters of paper sheets 72 are stacked on the stacker section 75.

In a normal mode, the movable paper discharge tray 76*b* is not moved and, as shown in FIG. 3A, the units of collated matters 73 are stacked without being horizontally offset with respect to one another. In a sort mode, on the other hand, the movable paper discharge tray 76*b* is moved horizontally in synchronization with the discharge timing of the sheets from the discharge section 74 and, as shown in FIG. 3(B), collated matters 73 are horizontally offset and stacked according to units.

In the meantime, in the collation operation process stated above, there are cases where collation errors that the sheets 72 are not conveyed from one or more of the paper feed trays 70*a* to 70*j* (which state will be referred to as "empty feed" hereinafter) or where a plurality of sheets 72 are simultaneously conveyed from one or more of the paper feed trays 70*a* to 70*j* (which state will be referred to as "stack paper feed" hereinafter), may occur. Conventionally, if such a collation error is detected, the collation operation is automatically stopped at the detection point. This is designed to allow an operator to instantly recognize the fact of a collation error and recognize that an erroneously collated matter is sorted.

Nevertheless, according to the conventional collating apparatus, if a collation error occurs, the operator is required to remove an erroneously collated matter from the paper discharge tray 76 and to restart a collation operation. This follows that the operator is obliged to always monitor the collating apparatus and to be responsible for the removal of such an erroneously collated matter, if any, and for a restart processing of restarting the collating operation whenever a collation error occurs. This is disadvantageously inconvenient for the operator and working efficiency becomes disadvantageously lower.

SUMMARY OF THE INVENTION

The present invention has been made to overcome the above-stated disadvantages. It is, therefore, an object of the present invention to provide a collating apparatus which does not require an operator to monitor a collation error and to conduct an error processing whenever a collation error occurs.

A collating apparatus according to the present invention is provided with a paper feed section, having a plurality of paper feed trays, for conveying a plurality of sheets stacked on the plurality of paper feed trays one by one at predetermined timing; a collating and conveying section for collating the plurality of sheets conveyed from the respective paper feed trays of the paper feed section to provide collated matters, and for conveying the collated matters to a discharge section; the discharge section for discharging the collated matters conveyed from the collating and conveying section to a stacker section; and the stacker section having a paper discharge tray for stacking the collated matters discharged from the discharge section, and is characterized by comprising erroneously collated matter selection and discharge means for discharging an erroneously collated matter so as to be distinguishable from other correctly collated matters when a collation error is detected during a collation operation.

According to this collating apparatus, if a collation error is detected, the erroneously collated matter selection and discharge means discharges the erroneously collated matter so as to be distinguishable from the correctly collated matters. Besides, the collation error can be recognized and the erroneously collated matter can be removed after the collation operation is completed for all collated matters. It is, therefore, possible to continue the collation operation without stopping the collation operation when a collation error occurs.

Here, it is possible to constitute the collating apparatus so that the collation operation is continued even after the erroneously collated matter selection and discharge means completes discharging the erroneously collated matter.

By doing so, the fact of the collation error can be recognized and the erroneously collated matter can be removed after the collation operation is completed for all of the collated matters without the need for an operator to conduct a restart processing of the collation operation when a collation error occurs.

Further, the erroneously collated matter selection and discharge means may be a pair of paper discharge wings each displaced between a wait position at which each of the paper discharge wings does not interfere with the collated matters discharged from the discharge section and an interference position at which each of the paper discharge wings interferes with the collated matters discharged from the discharge section and offsets a collated matter discharge direction almost in an orthogonal direction to the discharge direction, the paper discharge wings having opposite offsetting directions to each other, and the pair of paper discharge wings may stack the erroneously collated. matter while offsetting the erroneously collated matter with respect to the other correctly collated matters.

With this constitution, if there is a collation error, the paper discharge wings can stack the erroneously collated matter while offsetting the erroneously collated matter with respect to the other correctly collated matters.

Moreover, the erroneously collated matter selection and discharge means may be a conveying passage changing guide plate capable of selectively changing a conveying route of the collated matters conveyed from the collating and conveying section between a side of the stacker section and another route different from the stacker section side, and the conveying passage changing guide plate may allow the erroneously collated matter to take a conveying route different from a conveying route of the other corrected collated matters.

With this constitution, if there is a collation error, the conveying passage changing guide plate allows the erroneously collated matter to take a different conveying route from the conveying route of the correctly collated matters and to be discharged to a position different from the positions at which the correctly collated matters are discharged.

Furthermore, if a sort mode is selected as a paper discharge mode, a sorting operation may be carried out by alternately moving the pair of paper discharge wings from the wait position to the interference position in accordance with timing at which the collated matters are discharged from the discharge section; if a normal mode is selected as the paper discharge mode, a normal stacking operation may be carried out by locating each of the pair of paper discharge wings at the wait position; and if a collation error is detected in a normal mode, one of the pair of paper discharge wings may be moved from the wait position to the interference position with respect to the erroneously collated matter discharged from the discharge section.

Thus, the correctly collated matters are stacked in a normal state, whereas only the erroneously collated matter among the stacked matters is offset.

Additionally, if a sort mode is selected as a paper discharge mode, a sorting operation may be carried out by alternately moving the pair of paper discharge wings from the wait position to the interference position in accordance with timing at which the collated matters are discharged from the discharge section; if a normal mode is selected as the paper discharge mode, a normal stacking operation may be carried out by locating each of the pair of paper discharge wings at the wait position; and if the collation error is detected in the sort mode, the erroneously collated matter conveyed from the collating and conveying section may be forced to take a conveying route different from a conveying route of the other correctly collated matters.

Thus, the correctly collated matters are conveyed to the stacker section side, whereas the erroneously collated matter is conveyed to the different route side.

Other and further objects and features of the present invention will become obvious upon understanding of the illustrative embodiments about to be described in connection with the accompanying drawings or will be indicated in the appended claims, and various advantages not referred to herein will occur to one skilled in the art upon employing of the invention in practice.

DETAILED DESCRIPTION OF THE PREFERRED EMBODIMENTS

Figure 1:
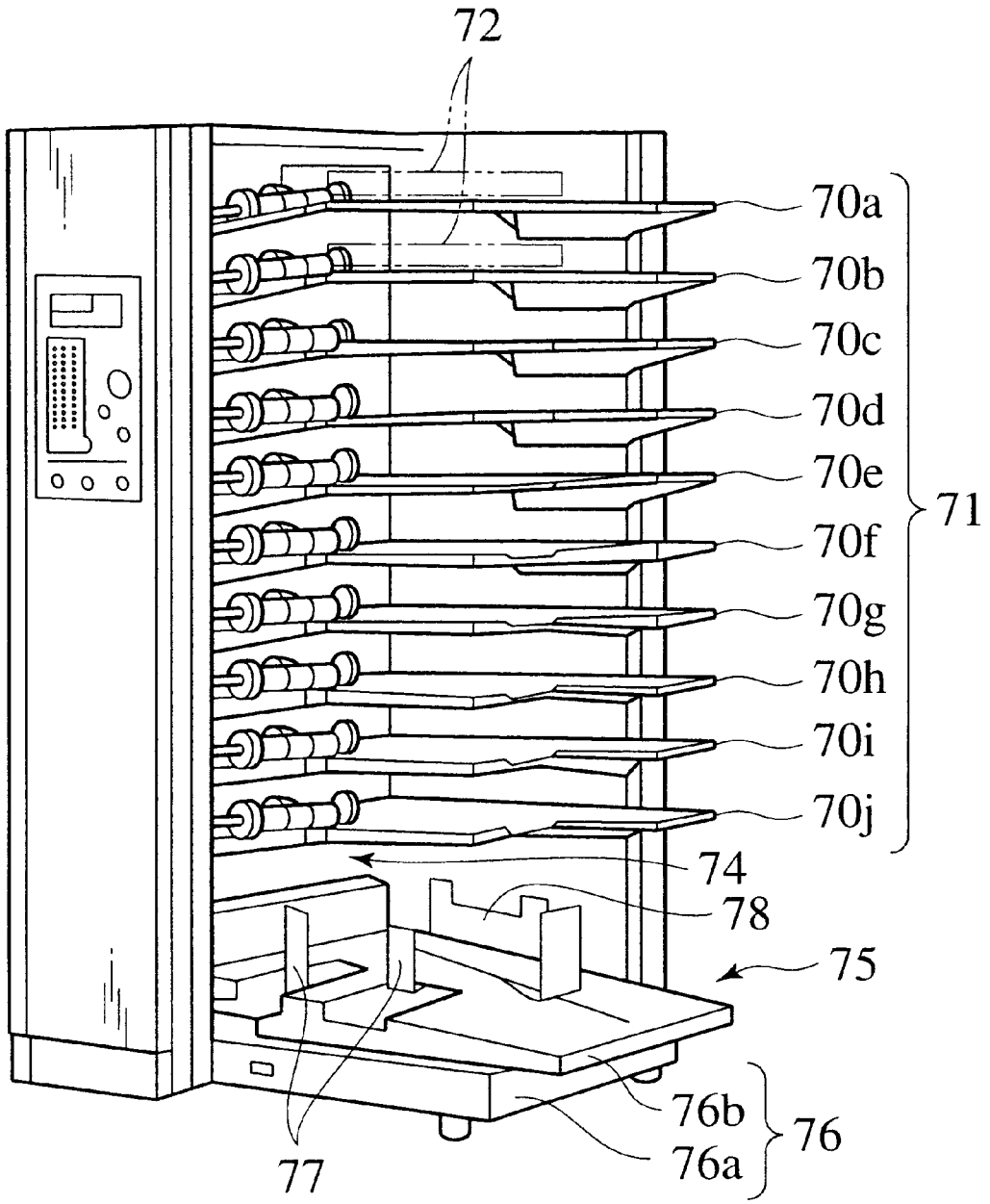
FIG. 1 is an overall perspective view of a conventional collating apparatus.
Figure 2:
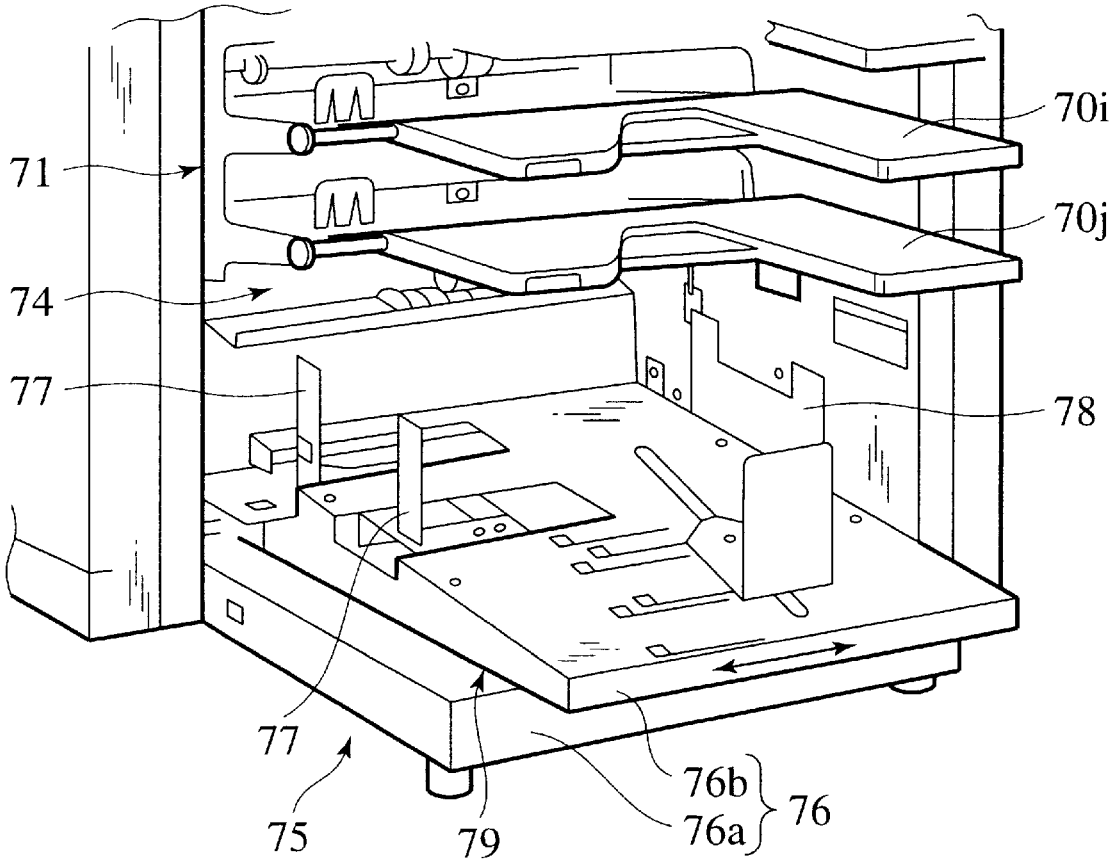
FIG. 2 is a perspective view of the neighborhood of a stacker section of the conventional collating apparatus.
Figure 3A:
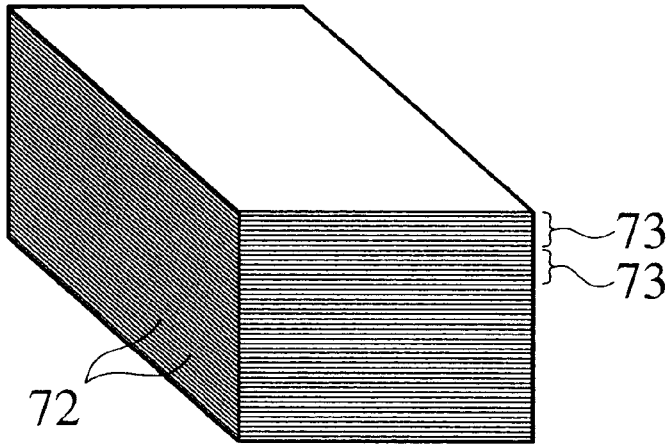
FIG. 3(A) is a perspective view showing a normal mode and FIG. 3(B) is a perspective view showing a sort mode.
Figure 3B:
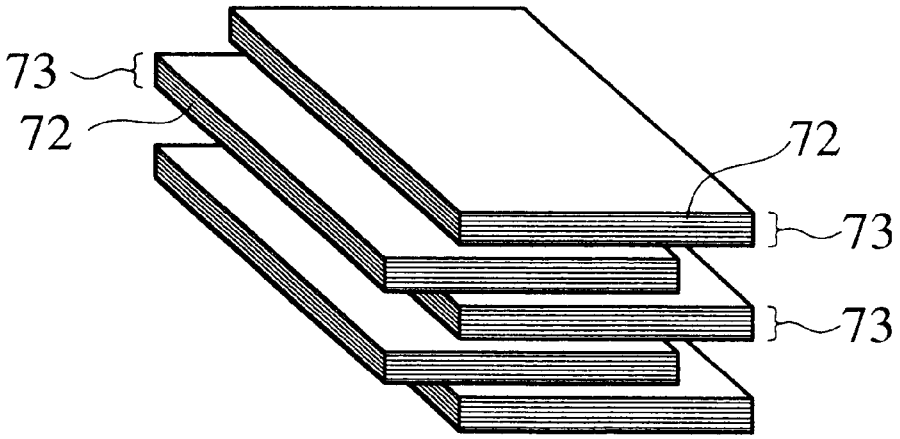
Figure 4:
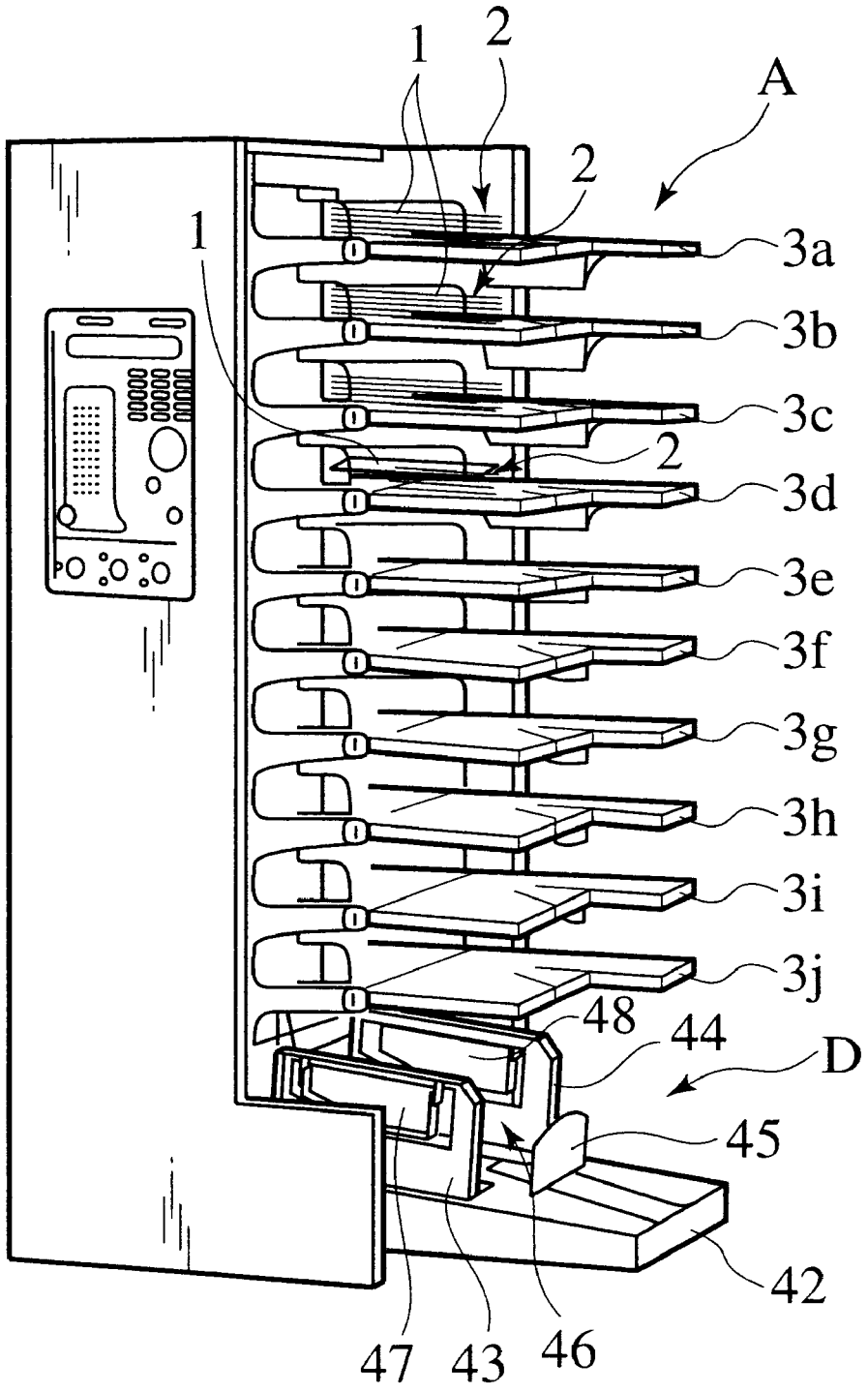
FIG. 4 is an overall perspective view of a collating apparatus in the first embodiment of the present invention.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

The embodiments of a collating apparatus according to the present invention will be described hereinafter with reference to the accompanying drawings.

As shown in FIGS. 4 to 7, the collating apparatus consists of a paper feed section A conveying a plurality of types (contents) of sheets 1 at predetermined timing one by one for each type, a collating and conveying section B collating the plural sheets conveyed from the paper feed section A and conveying them as collated matters 2 to a discharge section C, the discharge section C discharging the collated matters 2 from the collating and conveying section B to a stacker section D, and the stacker section D stacking thereon the collated matters 2 discharged from the discharge section C.

Figure 5:
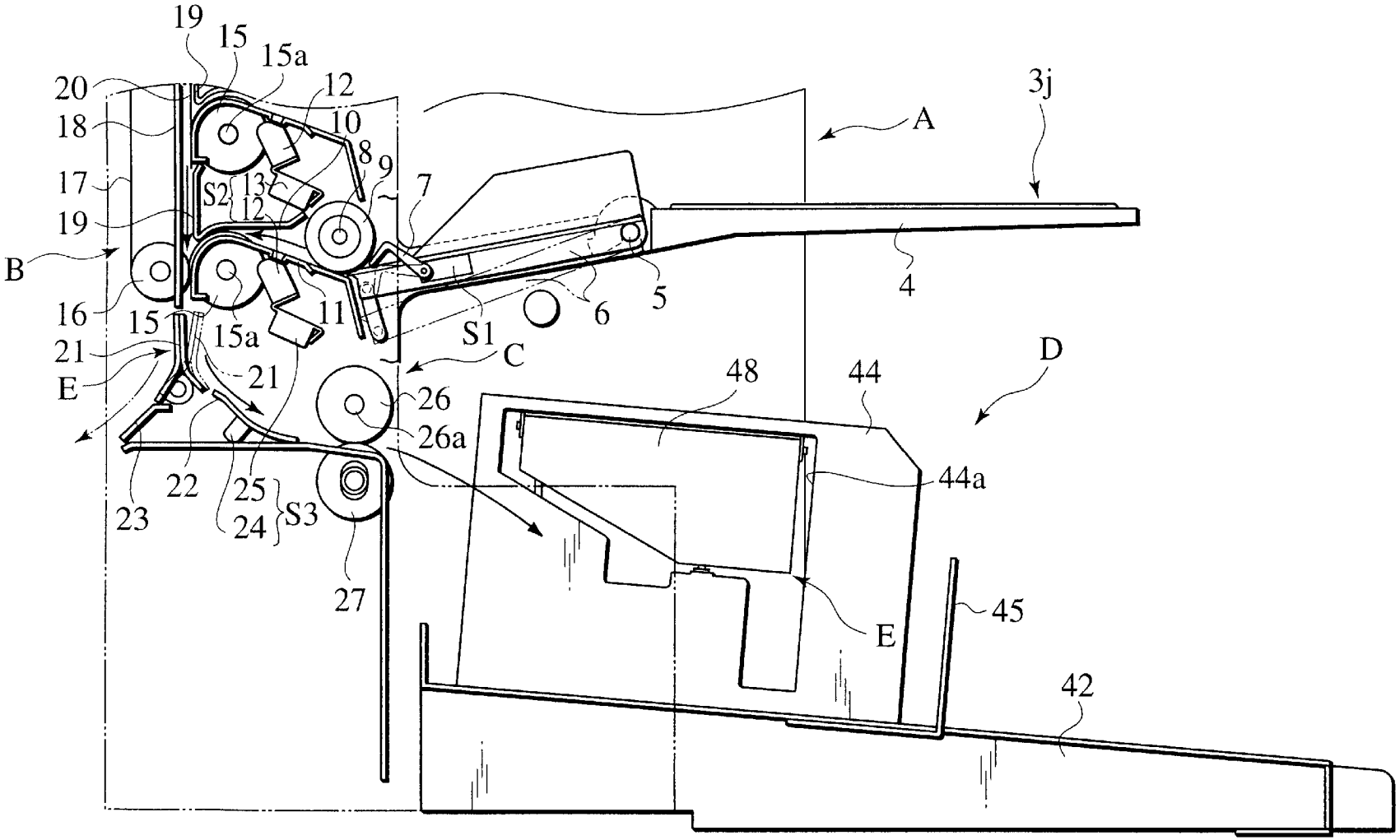
FIG. 5 is a block diagram showing a paper feed section, a collating and conveying section, a discharge section and a stacker section in the first embodiment of the present invention.

The paper feed section A has ten paper feed trays 3*a* to 3*j* which are vertically arranged. Each of these paper feed trays 3*a* to 3*j* consists of a fixed paper feed tray section 4 and a movable paper feed tray section 6 having a conveying tip end side vertically moving with a support shaft 5 used as a fulcrum as shown in FIG. 5 in detail. The movable paper feed tray section 6 is provided with a paper detection sensor S1 having a lever 7. The paper detection sensor S1 detects whether or not sheets 1 are stacked on the respective paper feed trays 3*a* to 3*j*. A paper feed roller 9 supported by a rotary shaft 8 is arranged at a position above the conveying tip end side of the movable paper feed tray section 6. If the movable paper feed tray portion 6 is positioned above, a stacked sheet 1 at the uppermost position is press-contacted with the paper feed roller 9.

When the paper feed roller 9 is rotated, only the stacked sheet 1 at the uppermost position is conveyed with the involvement of the effect of a stripper plate (not shown). An upper guide plate 10 and a lower guide plate 11 guiding sheets 1 to be conveyed are provided at positions downstream of the paper feed roller 9. The conveyed sheets 1 are guided by the upper and lower guide plates 10 and 11 and supplied to the collating and conveying section B.

A stack paper feed detector S2 has a light emission section 12 and a light reception section 13 arranged across the passages of the upper and lower guide plates 10 and 12 and detects whether or not the number of conveyed sheets 1 is one (the sheets 1 are stacked) based on a sensor output level. The detector S2 also detects the presence/absence of empty feed or sheet jamming based on whether or not there is a sensor output within a predetermined time after the start of the rotation of the paper feed roller 9. In other words, the stack paper feed section S2 detects a collation error.

Further, the rotation timing of each paper feed roller 9 corresponding to each of the paper feed trays 3*a* to 3*j* is controlled by a electromagnetic clutch (not shown) to be described below and sheets 1 are conveyed to the collating and conveying section B from each of the paper feed trays 3*a* to 3*j* at predetermined timing. The drive transfer system for the respective paper feed rollers 9 and the timing thereof will be described below.

As shown in FIG. 5 in detail, the collating and conveying section B has conveyer rollers 15 provided at the discharge sides of the upper and lower guide plates 10 and 11 corresponding to each of the paper feed trays 3*a* to 3*j*, and presser rollers 16 provided to face the conveyer rollers 15, respectively. Each of the presser rollers 16 arranged vertically is urged toward the corresponding conveyer roller 15 by a spring, which is not shown in FIG. 5, and a conveyer belt 17 is laid on these presser rollers 16. Each of the presser rollers 16 is press-contacted with the corresponding conveyer roller 15 through the conveyer belt 17. The drive transfer system of the conveyer rollers 15 will be described below.

Further, perpendicular guide plates 18 and 19 are provided on both sides of the conveyer belt 17 which is press-contacted with each conveyer roller 15 and each presser roller 16. A perpendicular conveying passage 20 is arranged between the perpendicular guide plates 18 and 19 at the both sides of the conveyer belt 17. One perpendicular guide plate 18 is comprised of a plate, whereas the other guide plate 19 is comprised of a plurality of plates integral with the upper and lower guide plates 10 and 11 of the paper feed section A.

When the respective rollers 15 rotate, the rotatable conveyer belt 17 is moved by the presser rollers 16 in response to the frictional force of the conveyer rollers 15 and the sheets 1 conveyed from the paper feed section A are put between the rotating conveyer rollers 15 and the moving conveyer belt 17 and conveyed downward over the perpendicular conveying passage 20. Here, if the sheet 1 at the lower paper feed tray side is conveyed to the collating and conveying section B at timing at which the sheet 1 conveyed from above passes through the conveyer rollers 15 provided below, the lower sheet is stacked on the upper sheet 1 and conveyed downward. The conveying operation and stacking operation of the sheets 1 are repeated to thereby create a desired collated matter 2 and the resultant collated matter 2 is conveyed to the discharge section C provided further below.

As shown in FIG. 5 in detail, the discharge section C has a conveying passage changing guide plate 21 which is rotatably provided between a stacker position indicated by a solid line and a position for a device for treating imaged-sheets indicated by a virtual line in FIG. 5. The conveying passage changing guide plate 21 is urged toward a stacker position side by a spring which is not shown in FIG. 5 and driven by a electromagnetic solenoid 81 (shown in FIG. 11). The conveying passage changing guide plate 21 is located at the stacker position when the electromagnetic solenoid 81 is turned off and at the imaged-sheet treatment device position (another route) when the electromagnetic solenoid 81 is turned on. At the stacker position, the upper end of the conveying passage changing guide plate 21 is positioned along one perpendicular guide plate 18 of the collating and conveying section B and the collated matters 2 conveyed from the collating and conveying section B are introduced toward the stacker section D side. At the imaged-sheet treatment device position, the upper end of the conveying passage changing guide plate 21 is positioned along the other perpendicular guide plate 19 of the collating and conveying section B and the collated matters 2 conveyed from the collating and conveying section B are introduced toward the opposite side to the stacker section D. The conveying passage changing guide plate 21 functions as erroneously collated matter selection and discharge means E in the sort mode. The function of the selection and discharge means E will be described later.

Further, a stacker section side guide plate 22 and an imaged-sheet treatment device side guide plate 23 are provided below the conveying passage changing guide plate 21. The collated matters 2 are conveyed selectively through the guide plates 22 and 23.

A discharge detection sensor S3 has a light emission section 24 and a light reception section 25 arranged across the stacker section side guide plate 22 and detects the discharge timing of the collated matters 2 based on a sensor output. Namely, when the collated matters 2 start passing through the sensor S3, a light from the light emission section 24 is shielded and the output of the light reception section 25 turns into L level. When the passage of collated matters 2 is finished, the light from the light emission section 24 is not shielded and the output of the light reception section 25 returns to H level. Based on this, the sensor S3 detects the discharge timing of the collated matters 2. The discharge detection sensor S3 also detects sheet jamming at the discharge section C when, for example, the sensor output is kept at high level H over a predetermined time.

A pair of discharge rollers 26 and 27, which are vertically arranged, are provided at the lowest downstream of the stacker section side guide plate 22, i.e., at positions confronting the stacker section D. The paired discharge rollers 26 and 27 are arranged in an almost press-contact state and the upper end portion of the lower discharge roller 27 is slightly protruded upward of the stacker section side guide plate 22. The upper discharge roller 26 is a driving roller, for which a drive transfer system will be described later. As the upper discharge roller 26 rotates, the lower discharge roller 27 rotates following the rotation of the upper discharge roller 26. The collated matters 2 conveyed from the collating and conveying section B are inserted between the paired discharge rollers 26 and 27 and discharged to the stacker section D in response to the. rotation of the paired discharge rollers 26 and 27.

Figure 6:
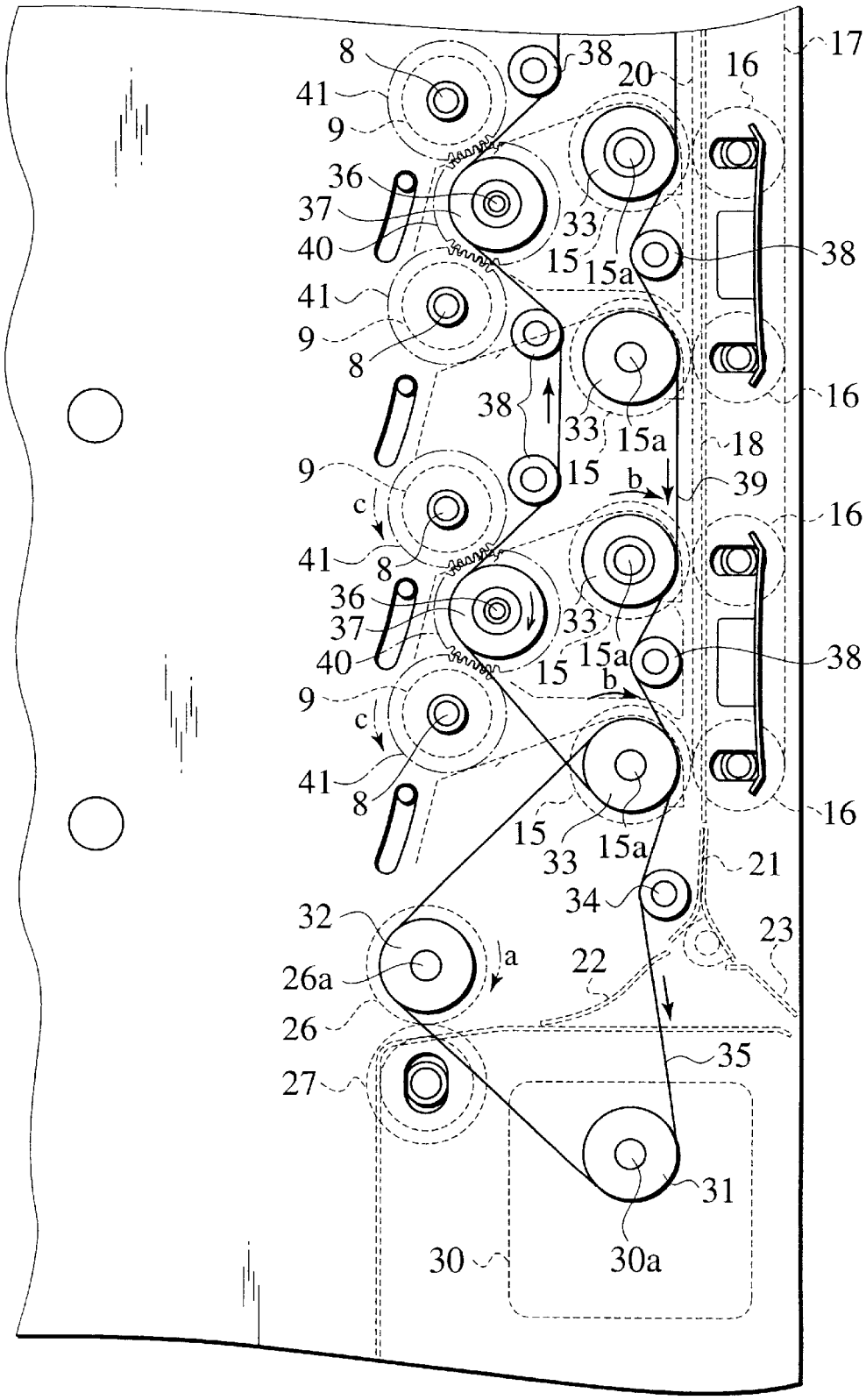
FIG. 6 is a side view showing a drive transfer system for transferring a driving force to the paper feed section, a collating and conveying section and the discharge section in the first embodiment of the present invention.

Next, description will be given to the drive transfer system of the paper feed rollers 9, the conveyer rollers 15 and the upper discharge. roller 26. As shown in FIG. 6, a driving pulley 31, a discharge pulley 32 and a conveying pulley 33 are fixed to the output shaft 30*a* of a main motor 30, the rotary shaft 26*a* of the discharge roller 26 and the rotary shaft 15*a* of the lowermost conveyer roller 15, respectively. The first driving belt 35 is laid on these pulleys 31, 32 and 33 and an auxiliary pulley 34.

Figure 7:
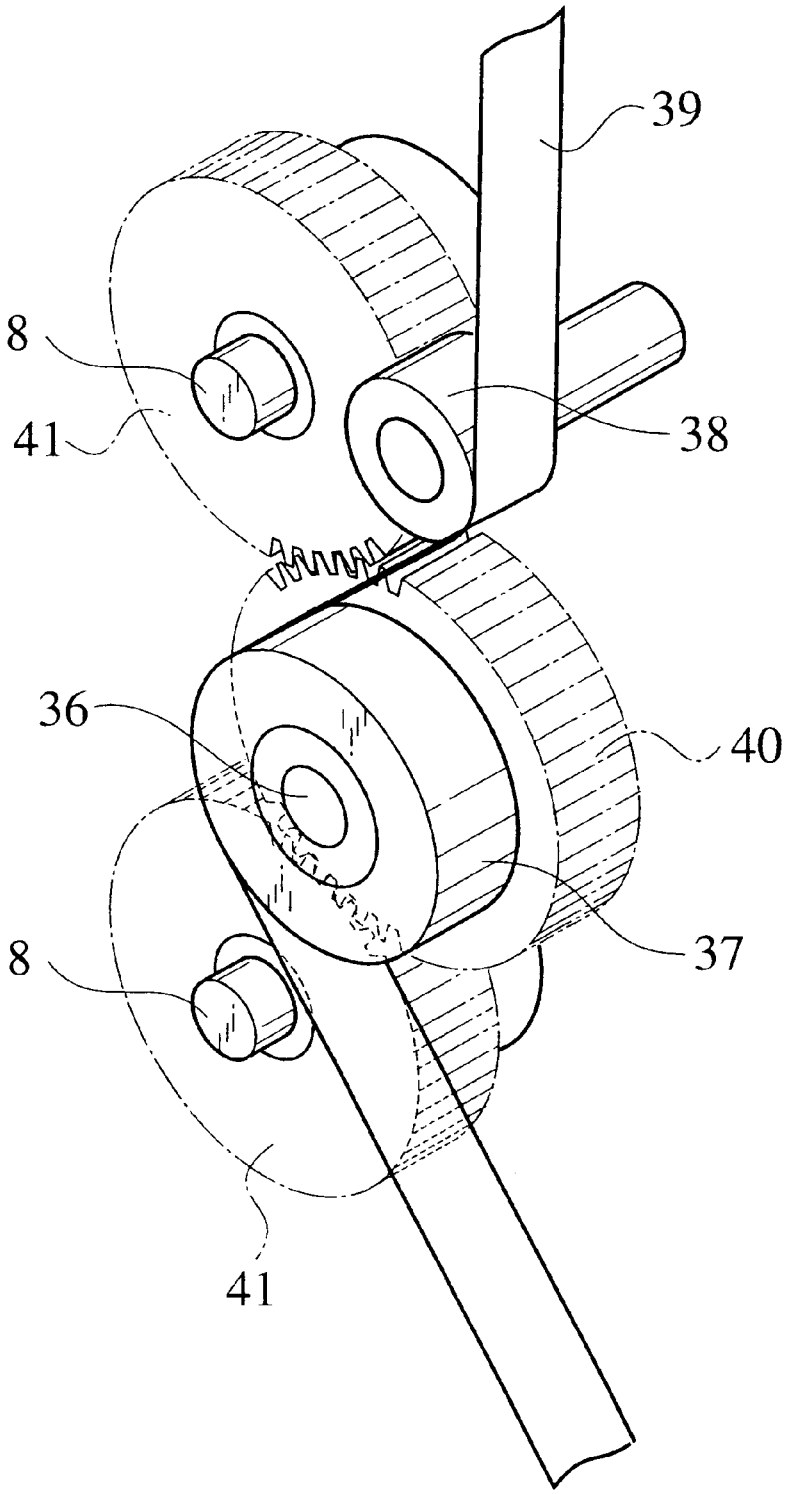
FIG. 7 is a perspective view showing the distribution of a driving force to the respective paper feed sections in the first embodiment of the present invention.

Further, a relay pulley 37 supported by a rotary shaft 36 is provided between the vertically adjacent paper feed rollers 9 and the conveying pulleys 33 are fixed to the rotary shafts 15*a* of the respective conveyer rollers 15. The second driving belt 39 is laid on these relay pulleys 37, the conveying pulleys 33 and the auxiliary pulleys 38. As shown in FIG. 7, a relay gear 40 is fixed to the rotary shaft 36 of each relay pulley 37 and paper feed gears 41 arranged at upper and lower positions are engaged with the relay gear 40, respectively. The paper feed gears 41 are coupled to the rotary shaft 8 of the paper feed roller 9 through electromagnetic clutches 82*a* to 82*j*, respectively.

When the main motor 30 is driven, the first driving belt 35 is moved and the upper discharge roller 26 is thereby rotated in a direction indicated by an arrow shown in FIG. 6. Following the movement of the first driving belt 35, the second driving belt 39 is moved to thereby rotate the respective conveyer rollers 15 in a direction indicated by an arrow b in FIG. 6 and the respective paper feed gears 41 are also rotated through the respective relay pulleys 37. Then, only the paper feed roller 9 having the electromagnetic clutch 82*a* to 82*j* turned on is rotated in a direction indicated by an arrow c shown in FIG. 6.

Figure 8:
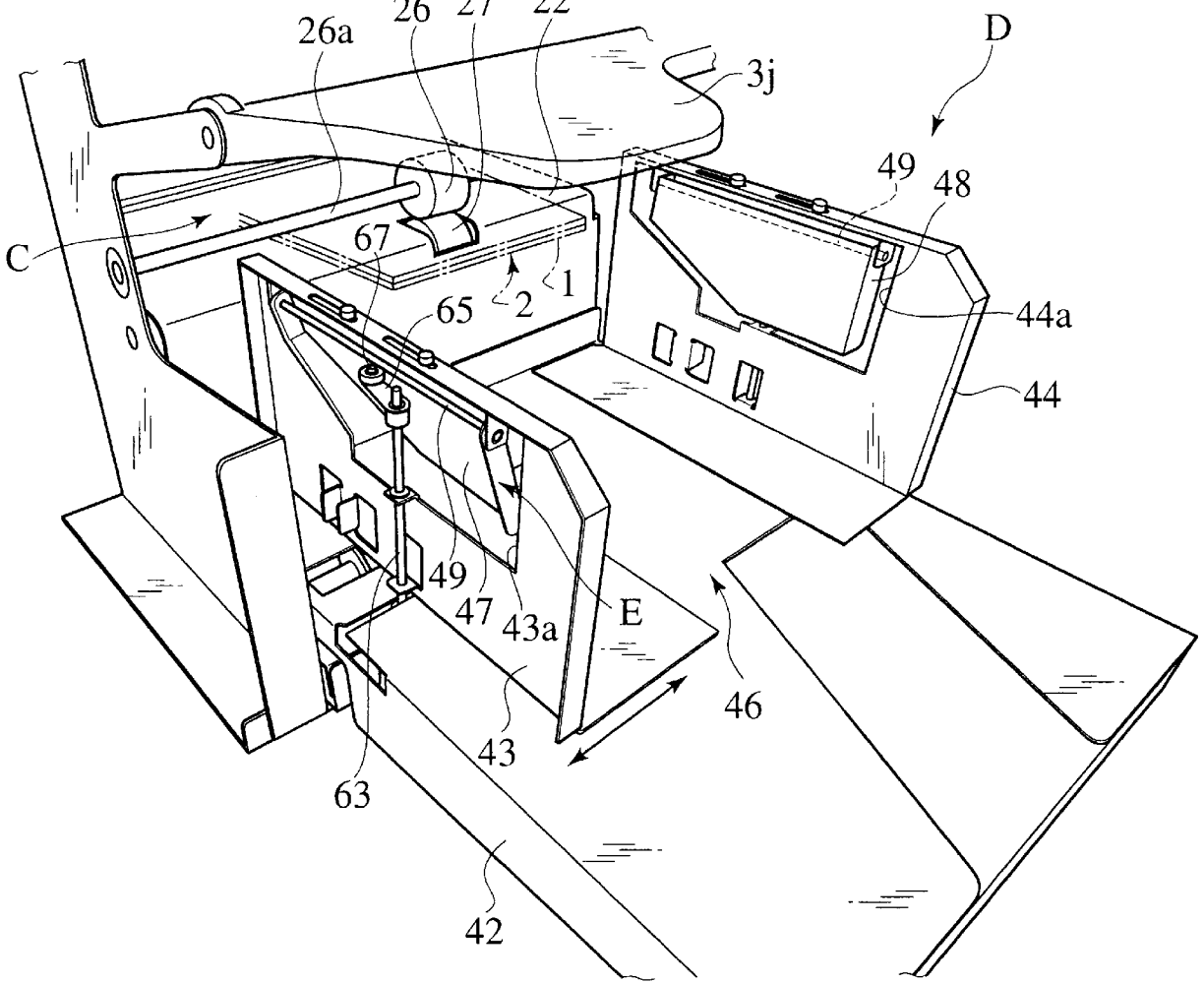
FIG. 8 is a perspective view of the stacker section in the first embodiment of the present invention.
Figure 9:
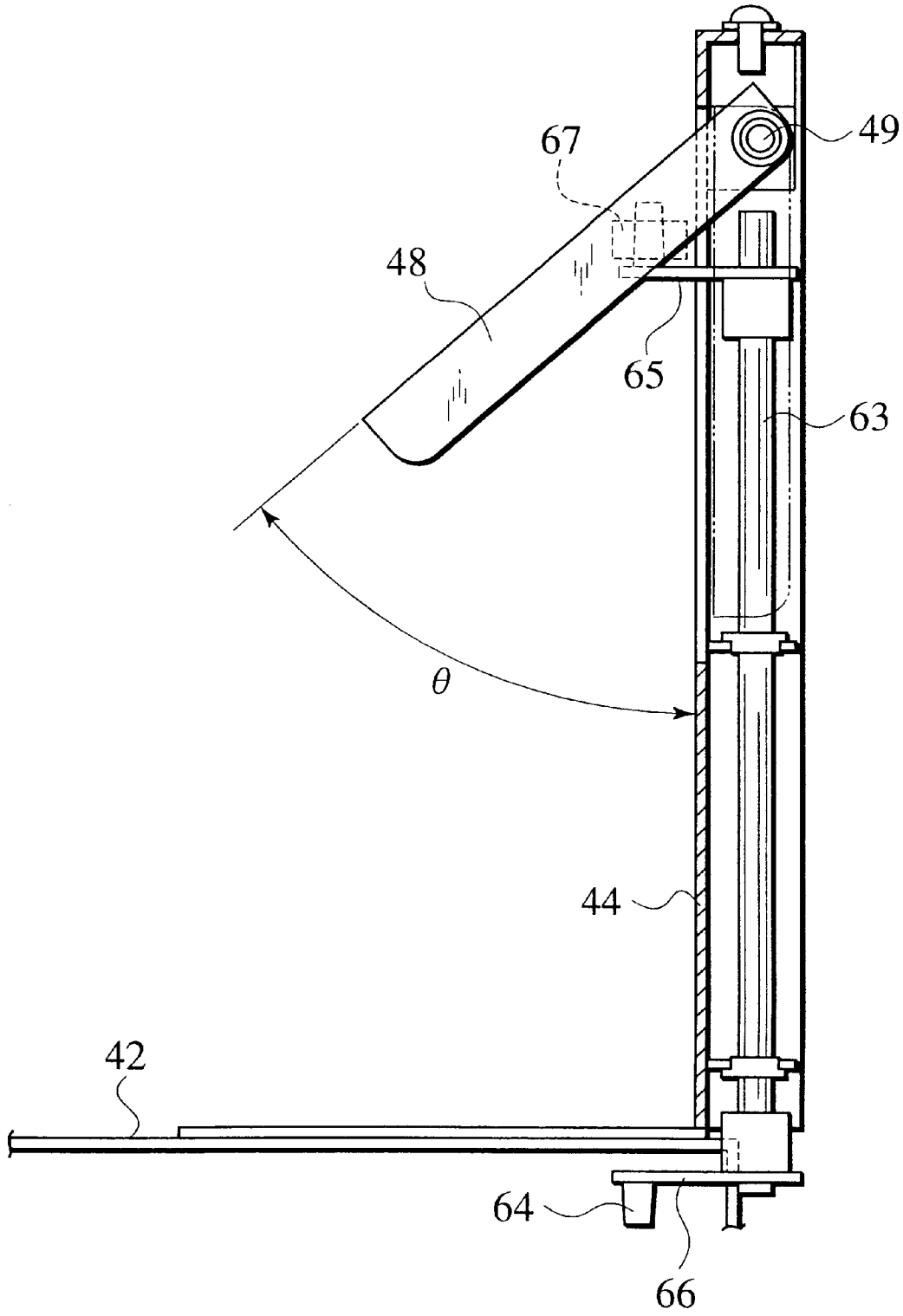
FIG. 9 is a partial front view of the stacker section in the first embodiment of the present invention.

FIG. 8 is a perspective view of the stacker section and FIG. 9 is a partial front view thereof.

As shown in FIGS. 8 and 9, the stacker section D has a paper discharge tray 42 provided at the falling position of the collated matters 2 discharged from the discharge section C and a pair of side fences 43 and 44 positioned at both outer sides of the collated matters 2 discharged onto the discharge tray 42 and restricting an orthogonal direction to the discharge direction of the collated matters 2. One of the paired side fences 43 and 44 (left fence in the drawings) is provided to be movable horizontally and the other fence (right fence in the drawings) is fixed to the paper feed tray 42. By moving. a side fence 43, the distance between paired side fence 43 and 44 is variable according to the width of the sheets 1 to be collated. A front fence 45 (shown in FIG. 4) is arranged on the paper feed tray 42 to restrict the forward side of the discharge direction of the collated matters 2. The front fence 45 is provided movably in an oblique direction to the discharge direction of the collated matters 2.

Moreover, the stacker section D is provided with sorting means 46. The sorting means 46 has a pair of paper discharge wings 47 and 48 provided in notch holes 43*a* and 44*a* of the paired side fences 43 and 44, respectively. The upper ends of the paired paper discharge wings 47 and 48 are rotatably supported through support shafts 49, respectively. Each of the paired paper discharge wings 47 and 48 is formed by bending a flat plate and part of the lower end of each wing is tapered so that the wing becomes gradually narrower toward the discharge section side. The paired paper discharge wings 47 and 48 are driven by a driving mechanism 50 so that each wing is displaced between a wait position (indicated by a virtual line shown in Fig .9) at which the wing does not interfere with the collated matters 2 discharged from the discharge section C and an interference position (indicated by a solid line shown in FIG. 9) at which the wing interferes with the collated matters 2 discharged from the discharge section C. The paired paper discharge wings 47 and 48 function as erroneously collated matter selection and discharge means. E in the normal mode. The function of the selection and descharge means E will be described later in detail.

Figure 10:
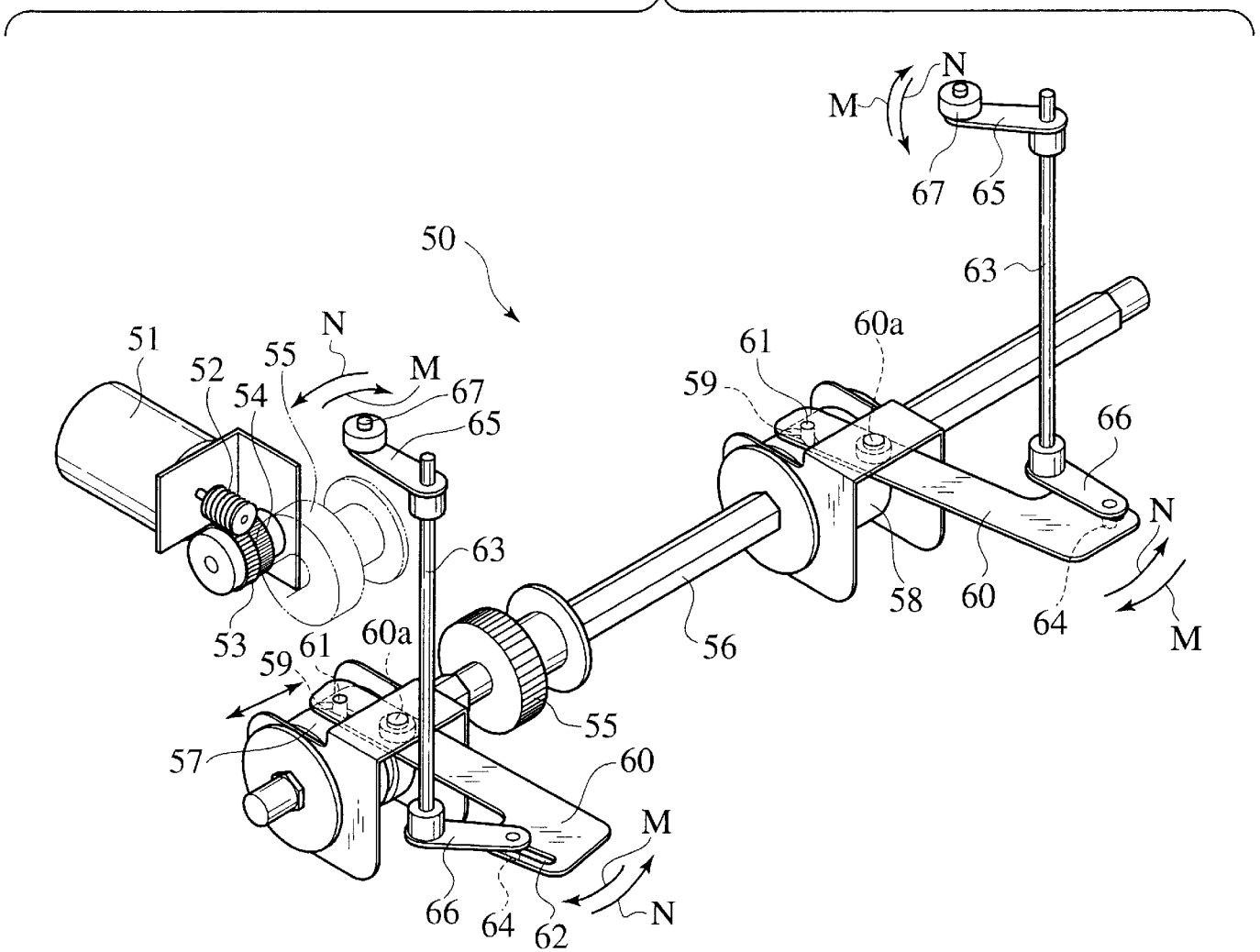
FIG. 10 is a perspective view of a paper discharge wing driving section in the first embodiment of the present invention.

FIG. 10 is a perspective view of a paper discharge wing driving mechanism.

As shown in FIG. 10, the driving mechanism 50 has a wing motor 51 serving as a driving source. A worm gear 52 is fixed to the output shaft of the wing motor 51. A worm wheel 53 is engaged with the worm gear 52. The first flat gear 54 is fixed coaxially, integrally with the worm wheel 53. The second flat gear 55 is engaged with the first flat gear 54. The second flat gear 55 is fixed to a hexagonal shaft 56. A pair of right and left cylindrical cams 57 and 58 are inserted into the hexagonal shaft 56. One cylindrical cam 57 (left cam in FIG. 10) is movable in axial direction, whereas the other cylindrical cam 58 (right cam in FIG. 10) is fixed. This is because when one side fence 43 (left fence in the drawings) is moved horizontally, the cylindrical cam 57 is moved together with the side fence 43 (left fence in the drawings) to thereby allow transferring a driving force. Transfer systems following the cylindrical cam 57 are all supported by one side fence 43 (left fence in the drawings) so as to move them together with the cylindrical cam 57.

Cam grooves 59 are formed on the outer peripheral surfaces of the paired cylindrical cams 57 and 58, respectively. The shapes of the cam grooves 59 are set to be 180-degree-symmetric with respect to each other about the rotation center of the hexagonal shaft 56. In a rotation range from a reference rotation position to a position at 180 degrees therefrom, only one horizontal link 60 and one perpendicular link 63 (left links in FIG. 10) to be described later are driven to be rotated. In a rotation range from the 180-degree rotation position to the reference rotation position, only the other horizontal link 60 and the other perpendicular link 63 (right links in FIG. 10) to be described later are driven to be rotated.

The paired horizontal links 60 are rotatably supported by the paired side fences 43 and 44 with support shafts 60*a* as fulcrums, respectively. Cam pins 61 engaged with the cam grooves 59 are fixed to one end sides of the horizontal links 60, respectively. Long holes 62 are formed on the other end sides of the horizontal links 60, respectively. The pins 64 of the perpendicular links 63 are inserted into the respective long holes 62. The paired perpendicular links 63 are rotatably supported by the paired side fences 43 and 44, respectively and a wing presser arm 65 and a lower arm plate 66 are fixed to the upper and lower ends of each of the perpendicular links 63. The above-stated pin 64 is fixed to the tip end of the lower arm plate 66. A roller 67 is rotatably provided on the tip end of the wing press arm 65. As shown in FIG. 8, the respective rollers 67 are arranged to be adjacent to the rear surfaces of the paired side fences 43 and 44, respectively.

That is to say, when the wing motor 51 rotates, the rotation thereof is transferred to the worm gear 52, the worm wheel 53, the first flat gear 54 and the second flat gear 55 in this order, whereby the paired cylindrical cams 57 and 58 rotate from the respective reference rotation positions. From the reference rotation positions to rotation positions at 180 degrees therefrom, only the left cylindrical cam 57 and the corresponding cam pin 61 are effective as a cam mechanism. The left horizontal link 60 and the left perpendicular link 63 rotate in a direction indicated by an arrow M shown in FIG. 10 and the discharge wing 47 at the left side rotates toward the interference position (in a state shown in FIG. 15(A)). Thereafter, the links 60 and 63 rotate in an opposite direction indicated by an arrow N shown in FIG. 10, whereby the discharge wing 47 at the left side returns from the interference position to the wait position by its self-weight. From the 180-degree rotation positions to the reference rotation positions, only the right cylindrical cam 58 and the corresponding cam pin 61 are effective as a cam mechanism. The right horizontal link 60 and the right perpendicular link 63 rotate in a direction indicated by the arrow N shown in FIG. 10 and the discharge wing 48 at the right side rotates toward the interference position (in a state shown in FIG. 15(B)). Thereafter, the links 60 and 63 rotate in an opposite direction indicated by the arrow M shown in FIG. 10, whereby the discharge wing 48 at the right side returns from the interference position to the wait position by its self-weight. A rotation angle θ (which is an angle at the interference position with respect to the perpendicular direction) of each of the discharge wings 47 and 48 is about 50 degrees.

Figure 11:
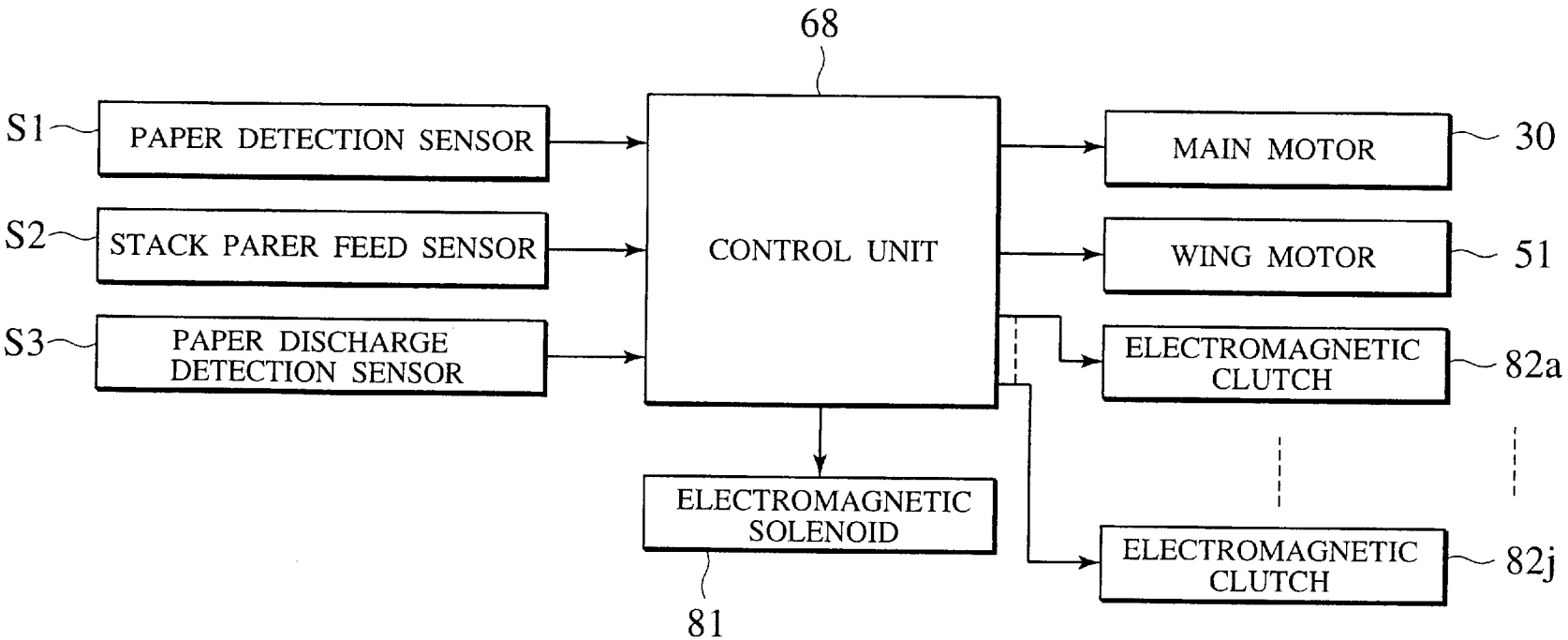
FIG. 11 is a circuit block diagram of paper discharge wings in the first embodiment of the present invention.

As shown in FIG. 11, the outputs of the paper detection sensor S1, the stack paper sensor S2 and the paper discharge sensor S3 are fed to a control section 68. Also, a command signal and the like are outputted from an operation panel (not shown) to the control section 68. The control section 68 controls the main motor 30, the wing motor 51, the electromagnetic solenoid 81 and the electromagnetic clutches 82*a* to 82*j* based on predetermined programs. In a collating operation mode, for example, the control section 68 controls the main motor 30, the wing motor 51, the electromagnetic solenoid 81 and the electromagnetic clutches 82*a* to 82*j* so as to execute a flow shown in FIG. 13. When the paper discharge mode is a sort mode, the control section 68 controls them so as to execute a flow shown in FIG. 12. When a collation error is detected, the control section 68 controls them so as to execute a flow shown in FIG. 14. The details of the control operation will be described in the following part for the description of function.

Figure 13:
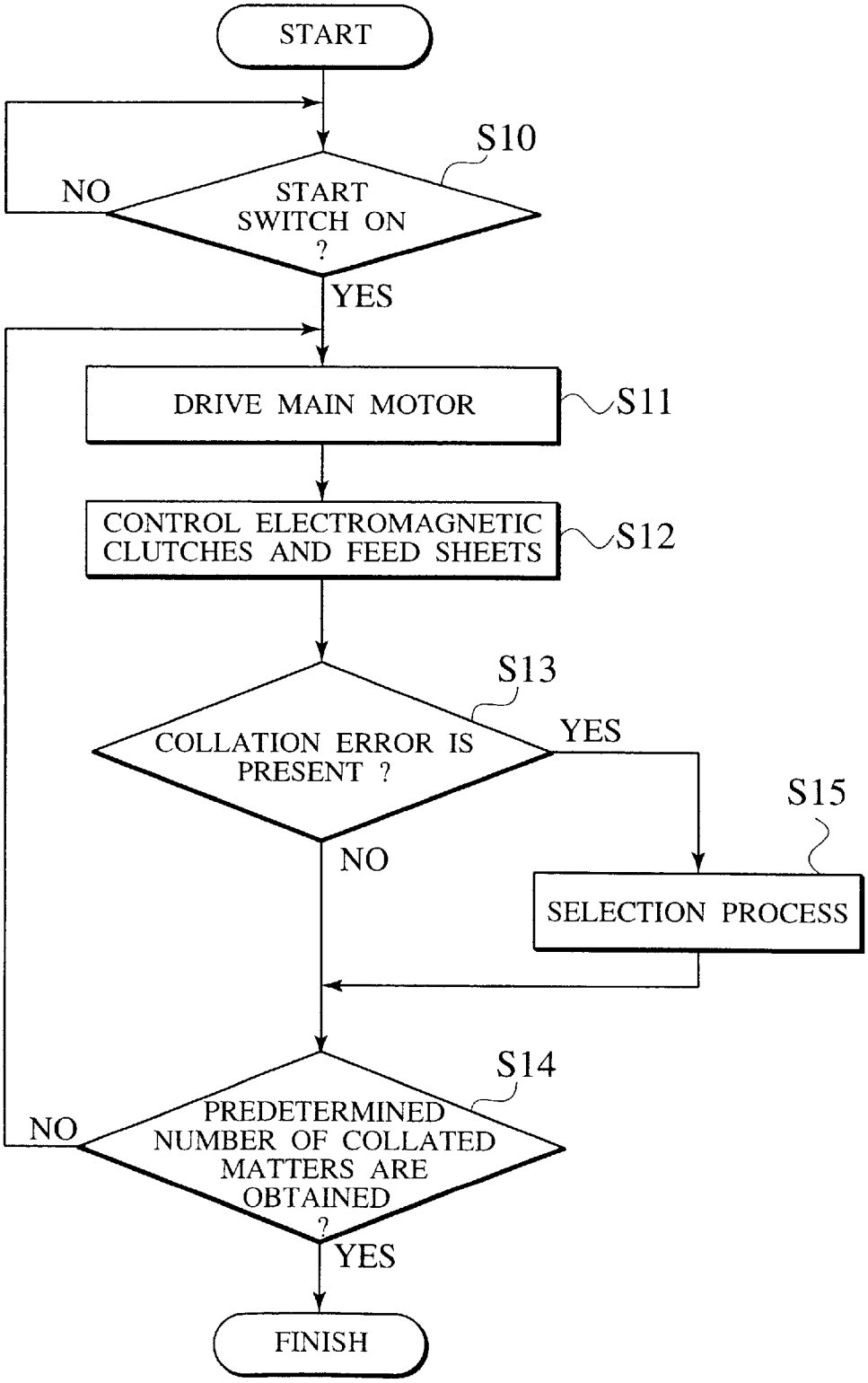
FIG. 13 is a schematic flow chart of a collating operation in the first embodiment of the present invention.

Next, the function of the above configuration will be described. For example, ten different types (different contents) of sheets are to be collated, many sheets 1 sorted according to types are stacked on the uppermost paper feed tray 3*a* to the lowermost paper feed tray 3*j*, respectively in a collation order. As shown in FIG. 13, when a start switch (not shown) is turned on (in a step S10), a collation operation starts. That is, the main motor 30 is driven (in a step S11) and the paper feed rollers 9 of the uppermost paper feed tray 3*a* to the lowermost paper feed tray 3*j* are sequentially rotated under the control of the respective electromagnetic clutches 82*a* to 82*j* in this order (in a step S12), thereby sequentially conveying the sheets 1 of the respective types (contents) to the collating and conveying section B one by one. The sheets 1 thus conveyed are collated on the portions of the conveyer rollers 15 and conveyed downward. The final collating treatment is conducted at the portion of the conveyer roller 15 at the lowermost position to thereby provide a desired collated matter 2. The collated matter 2 is fed to the discharge section C, progressed by the conveying passage changing guide plate 21 toward the stacker section D side and discharged to the stacker section D by the rotation of the paired discharge rollers 26 and 27. The series of these operations are continuously executed, thereby sequentially discharging collated matters 2 in units.

Here, if a normal mode is selected as a paper discharge mode, the widths of the paired side fences 43 and 44 are adjusted to be slightly larger than that of a sheet 1. Since the wing motor 51 is not driven and the paired paper discharge wings 47 and 48 are held at the respective wait positions, the collated matters 2 are stacked on the paper discharge tray 42 without being horizontally offset.

Figure 12:
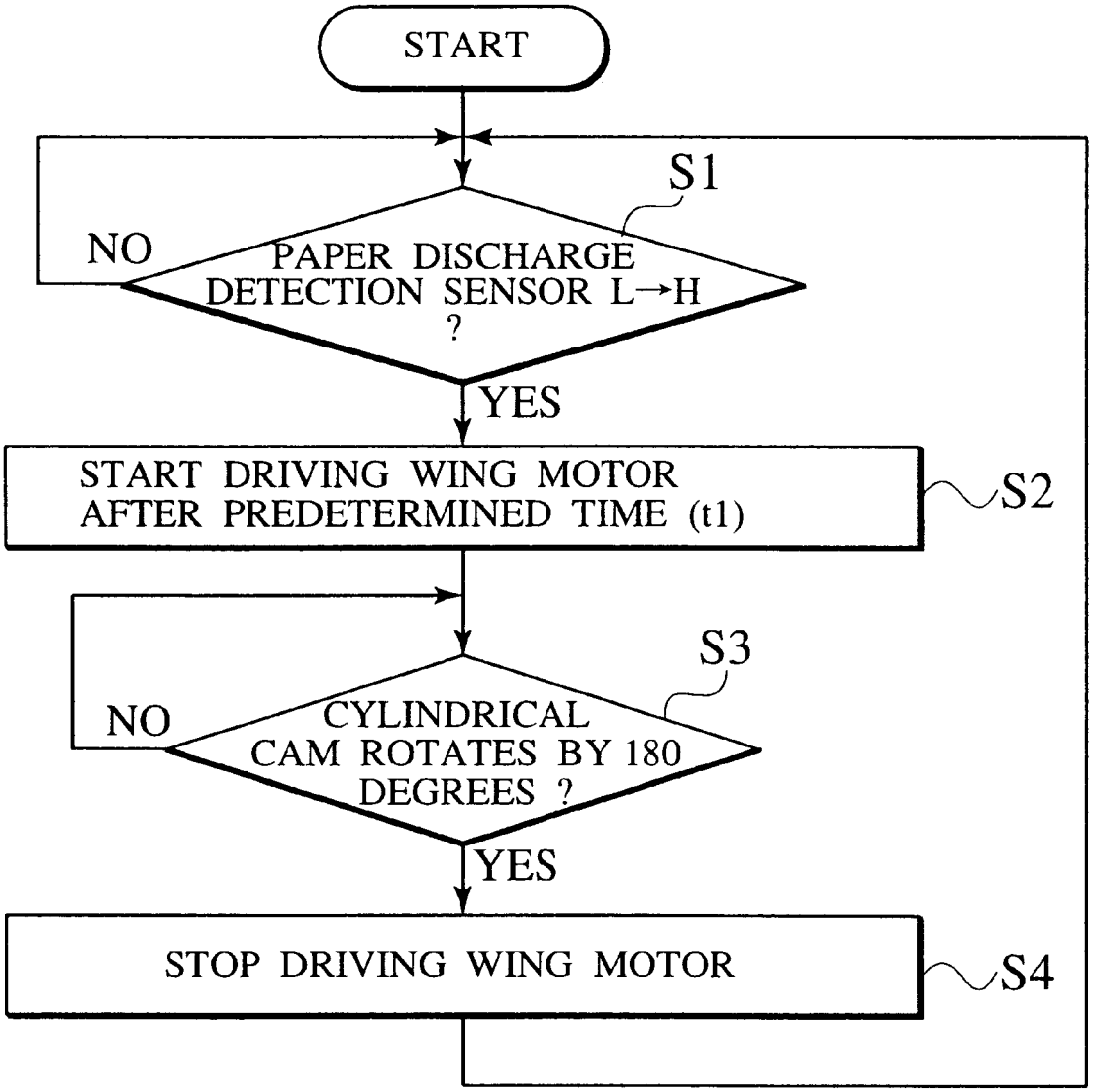
FIG. 12 is a flow chart of a sort mode in the first embodiment of the present invention.

If a sort mode is selected as a paper discharge mode, the widths of the paired side fences 43 and 44 are adjusted to be slightly larger than that of a sheet 1 (about +35 mm). As shown in FIG. 12, when. timing at which the detection output of the discharge detection sensor S3 is changed from L level to H level is detected (in a step S1), the wing motor 51 starts to be driven after a predetermined time (t1) (in a step S2). When the cylindrical cam 57 rotates from the reference rotation position by 180 degrees (in a step S3), the driving of the wing motor 51 stops (in a step S4). Next, when timing at which the detection output of the discharge detection sensor S3 is changed from L level to H level (in a step S1), the wing motor 51 starts to be driven after a predetermined time (t1) (in a step S2). When the cylindrical cam 57 rotates by 180 degrees (in a step S3), the driving of the wing motor 51 is stopped. As a result, the cylindrical cam 57 returns to the reference rotation position. Thereafter, whenever timing at which the detection output of the discharge detection sensor S3 is changed from L level to H level, the wing motor 51 is driven as stated above.

Figure 15A:
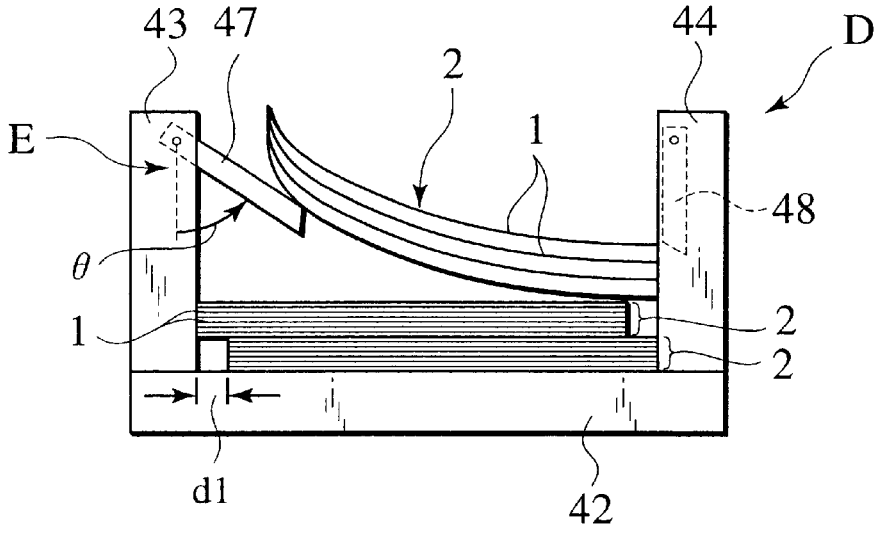
FIGS. 15(A) and 15(B) are schematic front views for describing the operation of the discharge wings, respectively, in the first embodiment of the present invention.
Figure 15B:
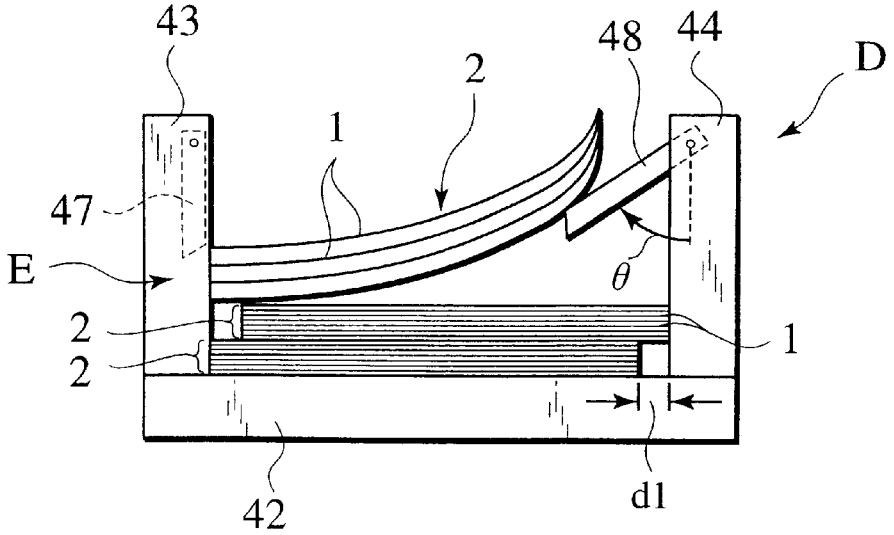

Here, when the cylindrical cam 57 rotates by 180 degrees from the reference rotation position, the left-side paper discharge wing 47 is displaced from the wait position to the interference position, the left end of the collated matter 2 discharged from the discharge section C comes in contact with the left-side paper discharge wing 47 and the right end of the collated matters 2 are abutted against the right side fence 44 and put on the paper discharge tray 42 as shown in FIG. 15(A). When the cylindrical cam 57 rotates from the 180-degree rotation position to the reference rotation position, the right-side paper discharge wing 48 is displaced from the wait position to the interference position, the right end of the collated matter 2 comes in contact with the right-side paper discharge wing 48 and the left end of the collated matter 2 is abutted against the left side fence 43 and put on the paper discharge tray 42 as shown in FIG. 15(B). The operations of the right and left paper discharge wings 47 and 48 are carried out synchronously with the collated matters 2 discharged, so that the collated matters 2 are stacked while being offset horizontally by a shift amount d1 for each collated matter 2.

Furthermore, in the course of the above-stated collation operation process, as shown in FIG. 13, the control section 68 checks whether or not a collation error occurs based on the output of the stack paper detection sensor S2 every time a unit of a collated matter is fed in response to the turned-on electromagnetic clutches 82*a* to 82*j* (in a step S13). If no collation error is detected, collation operation is carried out for predetermined number of collated matters and the apparatus is stopped (in a step S14). If a collation error (empty feed or stack paper feed) is detected, the erroneously collated matter selection and discharge means E is allowed to carry out a selection and discharge processing (in a step S15).

Figure 14:
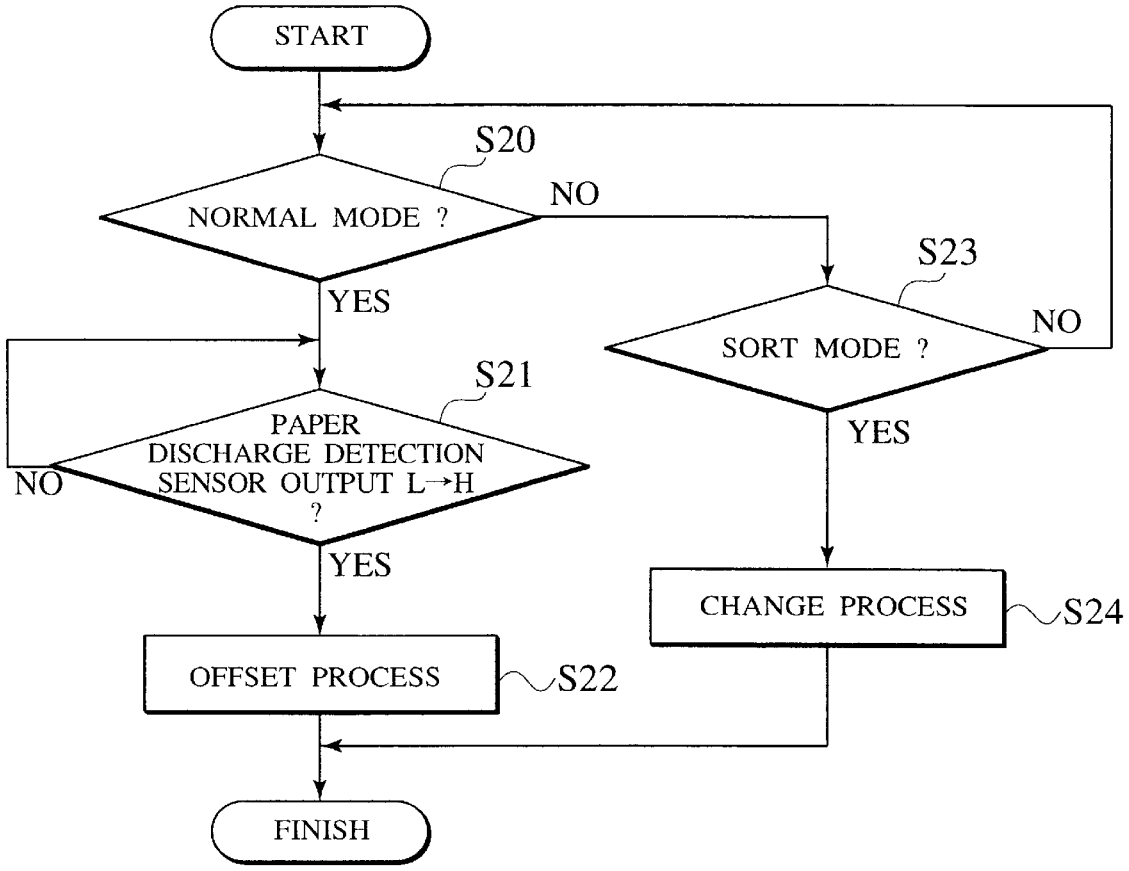
FIG. 14 is a selection processing flow chart of an erroneously collated matter selection and discharge means in the first embodiment of the present invention.
Figure 16A:
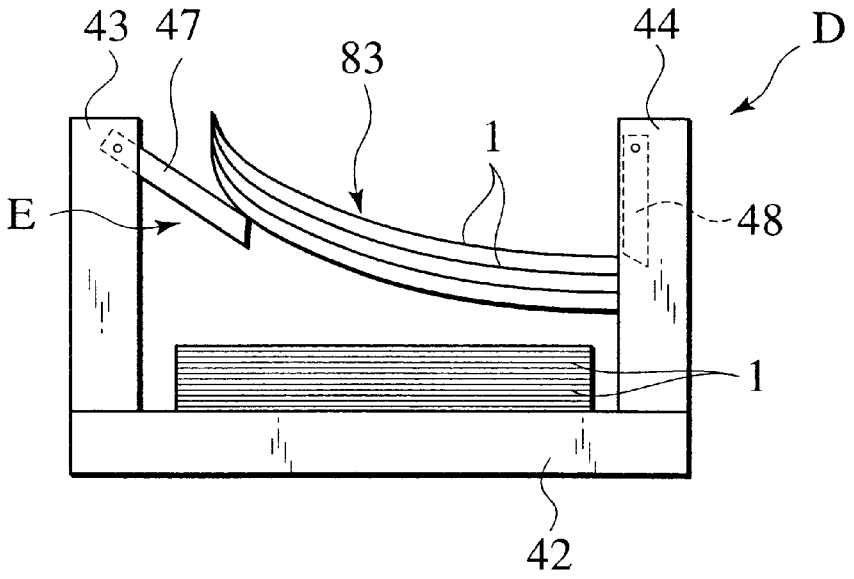
FIGS. 16(A) and 16(B) are schematic front views showing a state in which erroneously collated matter is offset by the discharge wings in the normal mode, and a state in which only the erroneously collated matter is offset, respectively, in the first embodiment of the present invention.
Figure 16B:
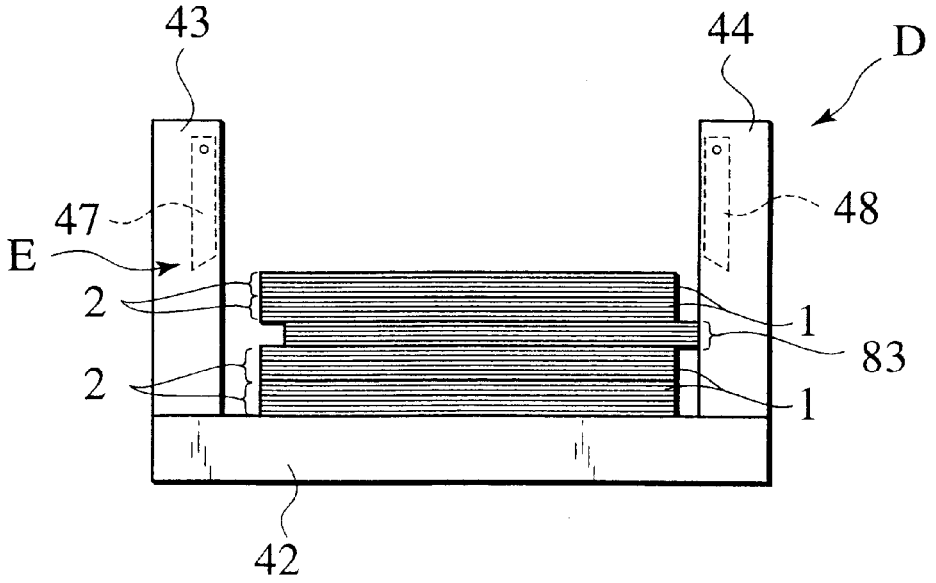

Next, description will be given to the selection and discharge processing of the erroneously collated matter selection and discharge means E. As shown in FIG. 14, if paper discharge is in a normal mode (in a step S20) and timing at which the output of the paper discharge detection sensor S3 is changed from L to H level is detected (in a step S21), then one paper discharge wing 47 is displaced to the interference position by driving the wing motor 51 as shown in FIG. 16(A), only an erroneously collated matter 83 is held offset with respect to the correctly collated matters 2 (in a step S22). It is noted that the other paper discharge wing 48 may be displaced to the interference position.

Figure 17:
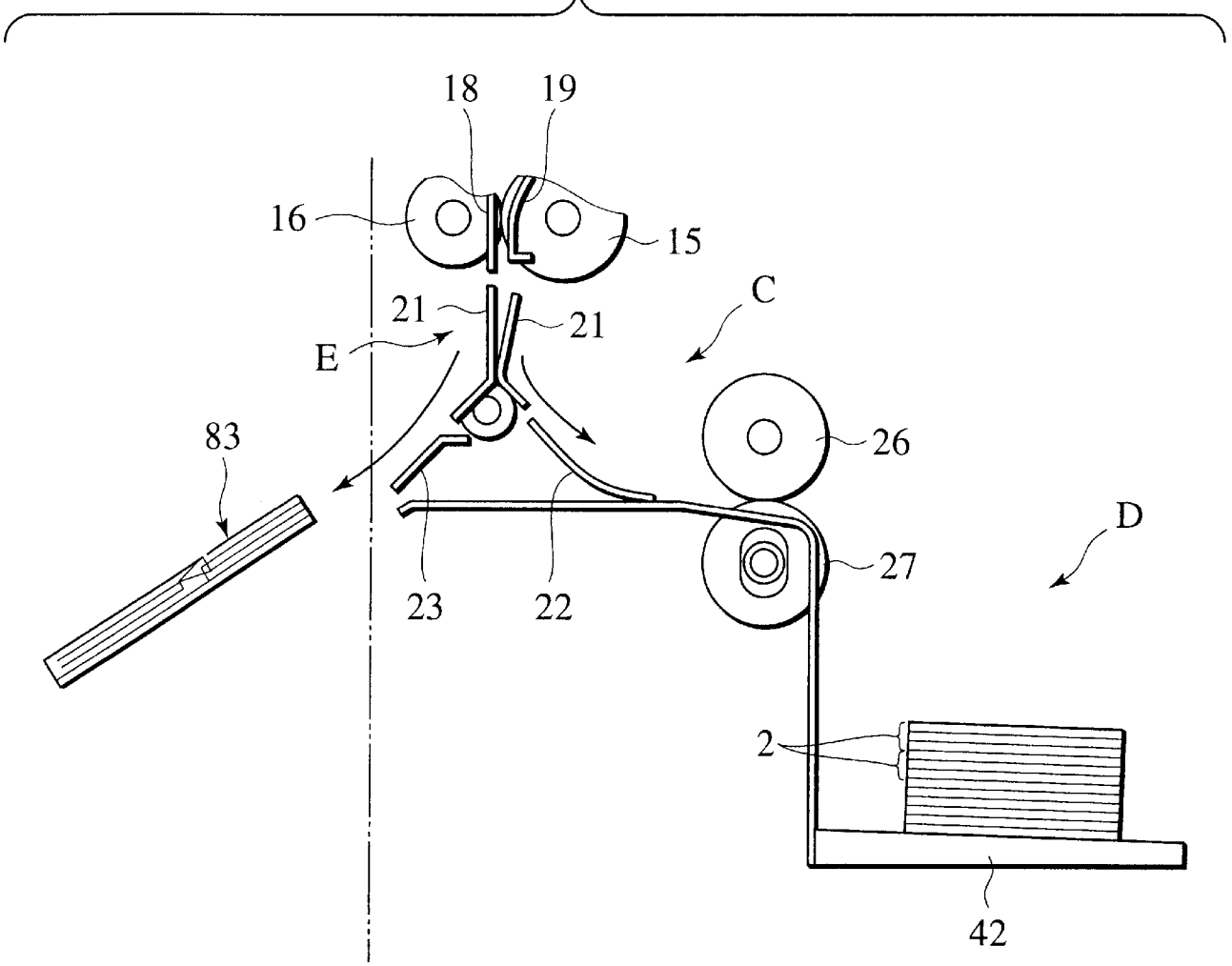
FIG. 17 is a view showing a state in which the erroneously collated matter is conveyed to a different route by a conveying passage changing guide plate and correctly collated matters are conveyed to the stacker section in the stacking mode in the first embodiment of the present invention.

If paper discharge is in a sort mode (in a step S23), the electromagnetic solenoid 81 is turned on only for a predetermined time. As indicated by a virtual line shown in FIG. 17, the conveying passage changing guide plate 21 is put at an imaged-sheet treatment device position and only an erroneously collated matter 83 is conveyed to an imaged-sheet treatment device conveying route opposite to the stacker section (in a step S24). As shown in FIG. 13, even after the erroneously collated matter selection and discharge means E finishes its selection processing (in a step S15), the collation operation is executed. The apparatus is not stopped until the collation operation has been executed for a predetermined number of collated matters (in a step S14).

As can be seen from the above, according to the present collating apparatus, if a collation error is detected, the paper discharge wing 47 and the conveying passage changing guide plate 21 serving as the erroneously collated matter selection and discharge means E discharge the erroneously collated matter 83 so as to be distinguishable from correctly collated matters 2. After the collation operation is completed for all the collated matters, the collation error can be recognized and the erroneously collated matter 83 can be removed. Thus, it is possible to continue the collation operation without stopping the operation during the occurrence of a collation error. In case of the first embodiment, even after a collation error is detected, a predetermined collation operation is executed. Accordingly, it is not necessary for an operator to monitor the presence of a collation error and to conduct an error processing every time a collation error occurs, thereby greatly improving working efficiency.

Next, the second embodiment of the present invention will be described. If comparing the second embodiment with the first embodiment, they are the same except for the constitution of the sorting means 46 of the stacker section D. To avoid repeating description, the same constituent elements will not be described herein and only the constitution of the sorting means 46 will be described. It is noted that the same constituent elements in the second embodiments as those in the first embodiment are denoted by the same reference symbols for clarification purposes.

Figure 18:
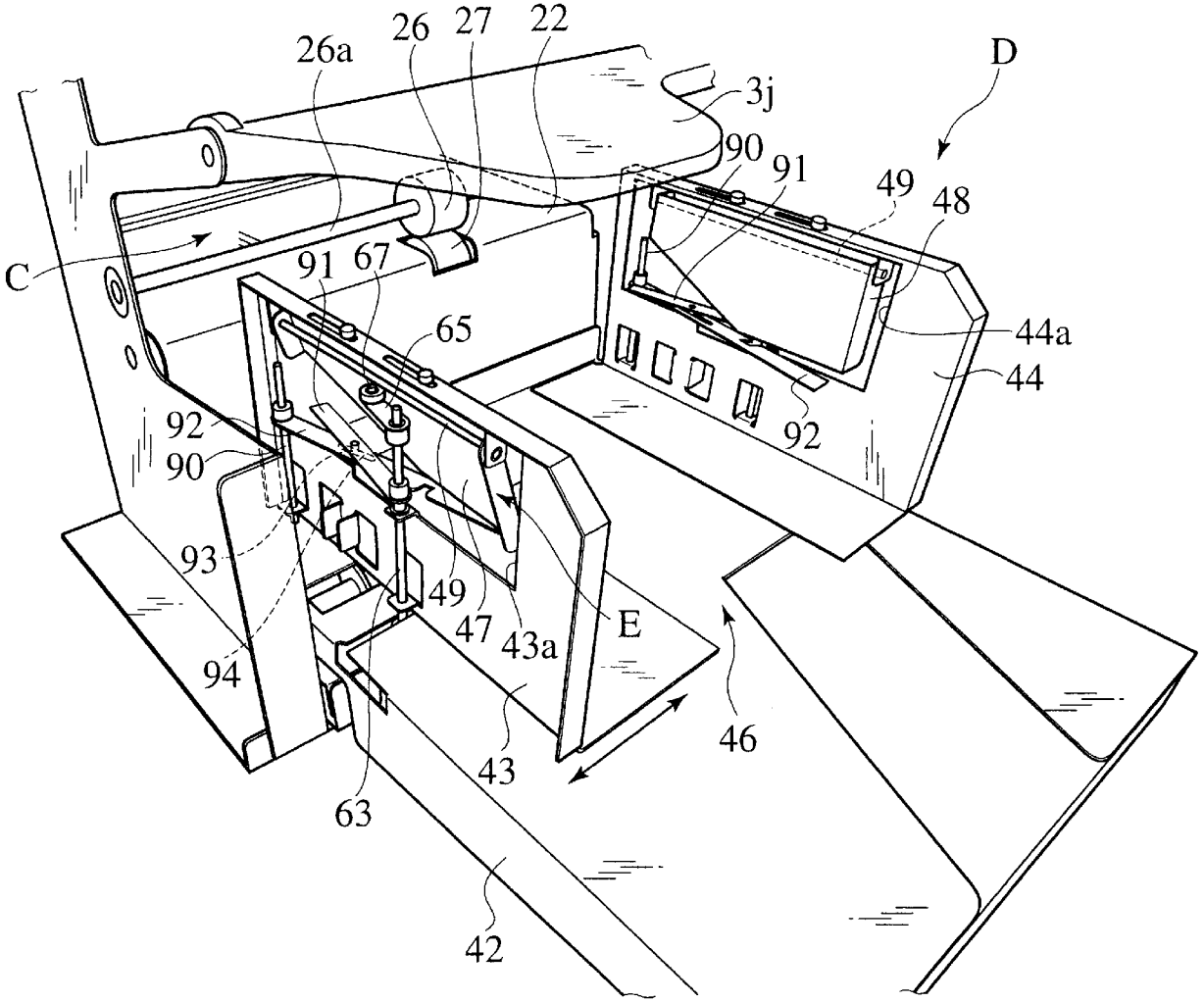
FIG. 18 is a perspective view of a stacker section of a collating apparatus in the second embodiment of the present invention.
Figure 19:
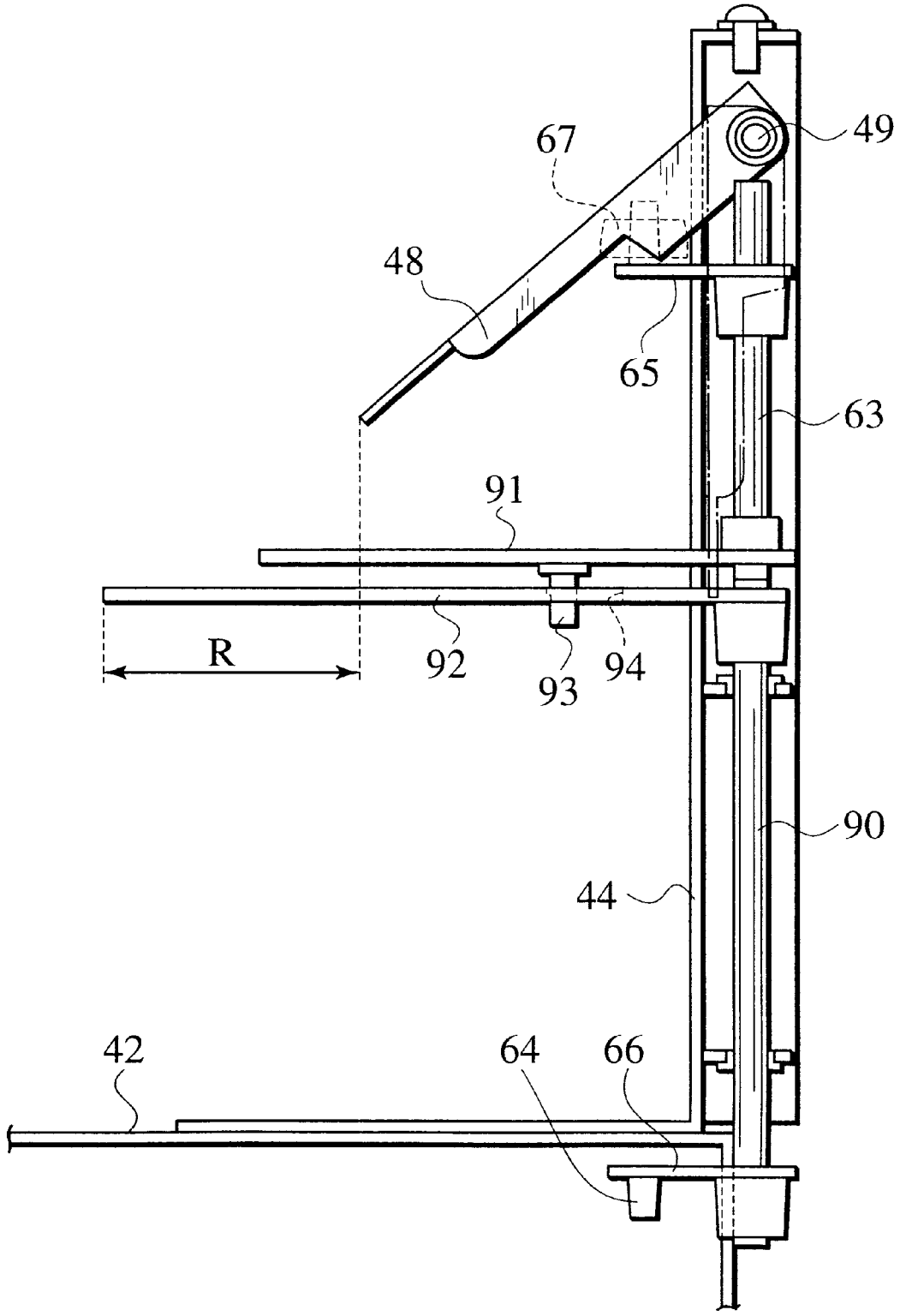
FIG. 19 is a partial front view of the stacker section in the second embodiment of the present invention.

Namely, as shown in FIGS. 18 and 19, a pair of auxiliary perpendicular links 90 as well as a pair of side fences 43 and 44 and a pair of perpendicular links 63 are rotatably provided at the sorting means 46 in the second embodiment. One ends of intermediate horizontal arms 91 and auxiliary arm members 92 extending in horizontal direction are fixed to the perpendicular links 63 and the auxiliary perpendicular links 90, respectively. Engagement pins 93 at the center of the horizontal arms 91 are engaged with long holes 94 at the center of the auxiliary arm members 92, respectively.

That is to say, the auxiliary arm members 92 move horizontally in cooperation with the rotation of corresponding wing presser arms 65. While the paper discharge wings 47 and 48 are at wait positions, the auxiliary arm members 92 are located at retreat positions (indicated by virtual lines in FIGS. 20(A) and 20(B) at which the members 92 do not interfere with collated matters 2 discharged from a discharge section C. While the paper discharge wings 47 and 48 are at interference positions, the auxiliary arm members 92 are located at protrusion positions (indicated by solid lines in FIGS. 20(A) and 20(B)) at which the members are below the wings 47 and 48 and protrude further inward of the tip ends of the paper discharge wings 47 and 48 by a dimension R. The remaining constituent elements of the sorting means 46 are the same as those in the first embodiment, which description will not be, therefore, given herein.

Figure 20A:
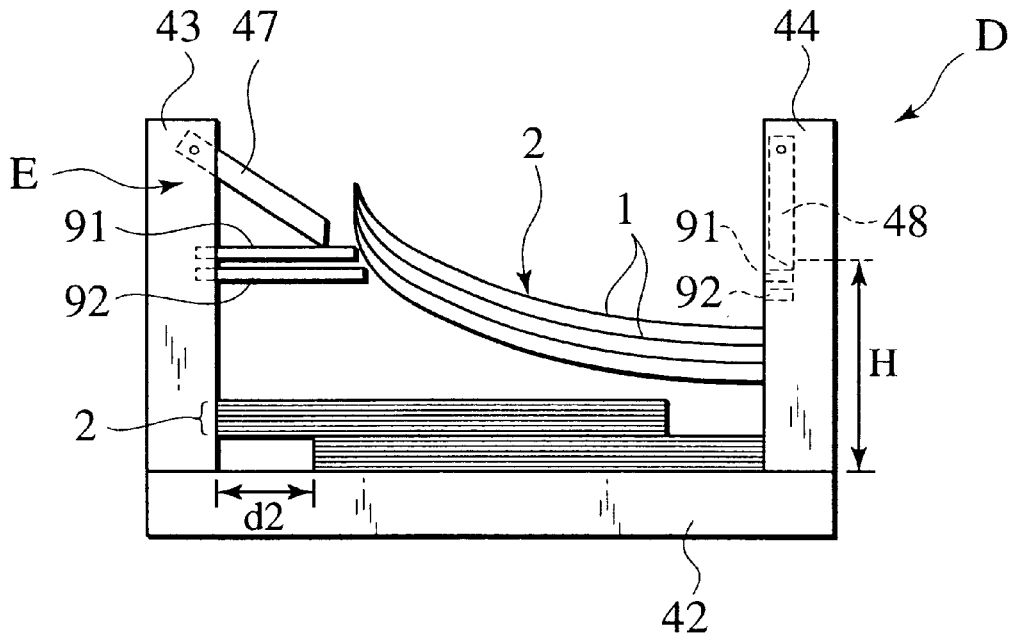
FIGS. 20(A) and 20(B) are schematic front views for describing the operation of discharge wings, respectively, in the second embodiment of the present invention.
Figure 20B:
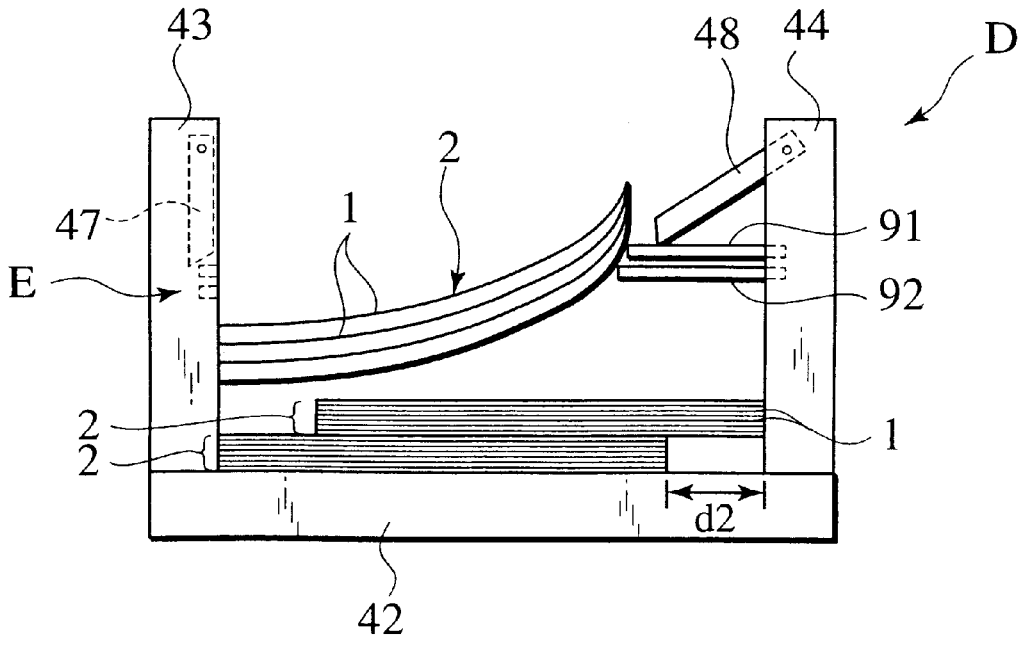

With the above constitution, as shown in FIGS. 20(A) and 20(B), the left-side paper discharge wing 47 and the right-side paper discharge wing 48 are controlled to be alternately moved to interference positions synchronously with the collated matter 2 discharged, whereby the same sorting operation can be carried out in the second embodiment as that of the first embodiment. In the second embodiment, as shown in FIGS. 20(A) and 20(B), the auxiliary arm members 92 are located further inside of the tip ends of the paper discharge wings 47 and 48 at their interference positions and the auxiliary arm members 92 interfere with the collated matters 2 further inside of the paper discharge wings 47 and 48 to change the discharge direction of the collated matters 2. Due to this, it is possible to increase a sorting offset quantity d2 without lengthening the paper discharge wings 47 and 48.

If a collation error is detected in a normal mode, either the paper discharge wing 47 or 48 is displaced to the interference position, whereby the second embodiment can obtain the same function and advantage as those of the first embodiment. That is to say, it is not necessary for an operator to observe the presence of a collation error and to conduct an error processing every time a collation error occurs, thereby greatly improving working efficiency.

In the first and second embodiments, the paper discharge wings 47 and 48 serving as the erroneously collated matter selection and discharge means E are controlled to be positioned at the wait positions when no collation error occurs in the normal mode. Only when a collation error is detected, one of the paper discharge wings 47 and 48 is controlled to be displaced to the interference position. Conversely, when no collation error occurs, one of the paper discharge wings 47 and 48 may be controlled to be always located at the interference position. When a collation error is detected, one of the paper discharge wings 47 and 48 may be controlled to be located at the wait positions. In short, it suffices that the collated matters are stacked on the paper discharge tray 42 while the erroneously collated matter 83 is offset with respect to the correctly collated matters 2.

In the above-stated embodiments, the collating apparatus having the paper discharge wing 47 and 48 has been described. The present invention is also applicable to a collating apparatus which is not provided with any paper discharge wing almost in the same manner. Namely, by utilizing a mechanism which conduct a sorting operation in a normal mode, collated matters may be stacked on the paper discharge tray 42 while an erroneously collated matter. 83 is offset with respect to correctly collated matters 2. For example, the present invention is applicable to a conventional collating apparatus having a movable paper discharge tray.

In the above-stated embodiments, the correctly collated matters 2 are stacked on the stacker section and the erroneously collated matter 83 is discharged to the imaged-sheet treatment device side (another route) in the sort -mode. If the correctly collated matters 2 are conveyed to the imaged-sheet treatment device side(another route), the erroneously collated matter 83 is discharge to the stacker section side. In short, the erroneously collated matter 83 may take a different discharge route from that of the correctly collated matters 2.

In the embodiments stated so far, the driving mechanism 50 of the paper discharge wings 47 and 48 is constituted by using the worm gear 52 and the worm wheel 53. The mechanism 50 may be constituted by using only flat gears.

OTHER EMBODIENTS

Various modifications will become possible for those skilled in the art after receiving the teachings of the present disclosure without depending from the scope thereof.

As stated so far, it is obvious that the present invention includes various embodiments besides the embodiments stated above. Accordingly, the technical scope of the present invention should be defined only by the following claims which are reasonably deduced from the above description.

What is claimed is:

1. A collating apparatus having an erroneously collated matter selection and discharge unit for discharging an erroneously collated matter so as to be distinguishable from correctly collated matters when a collation error is detected during a collation operation, wherein said erroneously collated matter selection and discharge unit comprises a pair of Paper discharge wings each displaced between a wait position at which each of the paper discharge wings does not interfere with the collated matters discharged from a discharge section of said collating apparatus and an interference position at which each of the paper discharge wings interferes with the collated matters discharged from said discharge section.

2. The collating apparatus of claim 1, wherein the collation operation is continued after said erroneously collated matter selection and discharge unit completes discharging the erroneously collated matter.

3. The collating apparatus of claim 1, wherein said erroneously collated matter selection and discharge unit offsets a collated matter discharge direction almost in an orthogonal direction to a discharge direction of said discharge section operating in said wait position, the paper discharge wings having opposite offsetting directions to each other, and the pair of paper discharge wings stack the erroneously collated matter while offsetting the erroneously collated matter with respect to correctly collated matters.

4. The collating apparatus of claim 1, wherein said erroneously collated matter selection and discharge unit is a conveying passage changing guide plate capable of selectively changing a conveying route of the collated matters conveyed from a collating and conveying section between a side of a stacker section and another route different from said stacker section side, and wherein the conveying passage changing guide plate allows the erroneously collated matter to take a conveying route different from a conveying route of correctly collated matters.

5. The collating apparatus of claim 3, wherein if a sort mode is selected as a paper discharge mode, a sorting operation is carried out by alternately moving said pair of paper discharge wings from the wait position to the interference position in accordance with timing at which the collated matters are discharged from said discharge section, and if a normal mode is selected as the paper discharge mode, a normal stacking operation is carried out by locating each of said pair of paper discharge wings at the wait position; and if the collation error is detected in a normal mode, one of said pair of paper discharge wings is moved from the wait position to the interference position with respect to the erroneously collated matter discharged from said discharge section.

6. The collating apparatus of claim 4, wherein if a sort mode is selected as a paper discharge mode, a sorting operation is carried out by alternately moving said pair of paper discharge wings from the wait position to the interference position in accordance with timing at which the collated matters are discharged from said discharge section, and if a normal mode is selected as the paper discharge mode, a normal stacking operation is carried out by locating each of said pair of paper discharge wings at the wait position; and if the collation error is detected in the sort mode, the erroneously collated matter conveyed from said collating and conveying section is forced to take a conveying route different from a conveying route of the correctly collated matters.

* * * * *